US010138704B2

(12) United States Patent
Mitchell et al.

(10) Patent No.: US 10,138,704 B2
(45) Date of Patent: Nov. 27, 2018

(54) STRADDLE PACKER SYSTEM

(71) Applicant: Weatherford Technology Holdings, LLC, Houston, TX (US)

(72) Inventors: Michael Wilbert Mitchell, Cypress, TX (US); Damon Henry Nettles, Houston, TX (US)

( * ) Notice: Subject to any disclaimer, the term of this patent is extended or adjusted under 35 U.S.C. 154(b) by 581 days.

(21) Appl. No.: 14/318,147

(22) Filed: Jun. 27, 2014

(65) Prior Publication Data

US 2015/0376979 A1 Dec. 31, 2015

(51) Int. Cl.
*E21B 33/124* (2006.01)
*E21B 34/06* (2006.01)

(52) U.S. Cl.
CPC ..... *E21B 34/06* (2013.01); *E21B 33/124* (2013.01)

(58) Field of Classification Search
CPC ..... E21B 33/124
See application file for complete search history.

(56) References Cited

U.S. PATENT DOCUMENTS 2,738,012 A * 3/1956 Springer ..... E21B 33/124 166/145
3,024,846 A 3/1962 Gage
3,096,823 A 7/1963 Crowe
3,526,278 A 9/1970 Scott
4,429,747 A * 2/1984 Williamson, Jr. .... E21B 34/103 166/321
4,485,876 A 12/1984 Speller
4,560,005 A * 12/1985 Helderle ..... E21B 34/14 166/332.2
4,566,535 A * 1/1986 Sanford ..... E21B 33/1243 166/113
4,605,062 A 8/1986 Klumpyan et al.
4,856,583 A 8/1989 Greenlee et al.
5,360,069 A 11/1994 Schmuck et al.
5,782,306 A 7/1998 Serafin
6,253,856 B1 7/2001 Ingram et al.
6,257,339 B1 7/2001 Haugen et al.
6,474,419 B2 11/2002 Maier et al.
6,655,461 B2 12/2003 Eslinger et al.
6,695,057 B2 2/2004 Ingram et al.
6,782,954 B2 8/2004 Serafin et al.
6,823,945 B2 11/2004 Eslinger et al.
6,832,654 B2 12/2004 Ravensbergen et al.
6,883,610 B2 4/2005 Depiak
(Continued)

FOREIGN PATENT DOCUMENTS

GB 2398585 A 8/2004

OTHER PUBLICATIONS

EPO Extended European Search Report dated Dec. 9, 2015, for EPO Application No. 15172465.5.
(Continued)

*Primary Examiner* — D. Andrews

(57) ABSTRACT

A straddle packer system includes an upper seal member, a lower seal member, an upper equalizing valve configured to equalize pressure across the upper seal member, a lower equalizing valve configured to equalize pressure across the lower seal member, and an anchor. The upper and lower seal members do not move when actuating the upper and lower equalizing valves, respectively, into an unloading position to equalize the pressure across the upper and lower seal members.

22 Claims, 16 Drawing Sheets

(56) References Cited

U.S. PATENT DOCUMENTS

| | | | | |
|---|---|---|---|---|
| 7,011,157 | B2 | 3/2006 | Costley et al. | |
| 7,032,675 | B2 | 4/2006 | Steele et al. | |
| 7,051,812 | B2 | 5/2006 | McKee et al. | |
| 7,472,746 | B2 | 1/2009 | Maier | |
| 7,478,676 | B2 | 1/2009 | East, Jr. et al. | |
| 7,484,565 | B2 | 2/2009 | van Batenburg et al. | |
| 7,766,088 | B2 | 8/2010 | Saucier et al. | |
| 8,016,032 | B2 | 9/2011 | Mandrell et al. | |
| 8,186,446 | B2 | 5/2012 | Ingram et al. | |
| 9,267,348 | B2 | 2/2016 | Ingram et al. | |
| 9,291,044 | B2 | 3/2016 | Murphy et al. | |
| 2002/0125005 | A1 | 9/2002 | Eslinger et al. | |
| 2002/0153142 | A1 | 10/2002 | Eslinger et al. | |
| 2004/0129421 | A1 | 7/2004 | Hoffman et al. | |
| 2004/0251022 | A1 | 12/2004 | Smith | |
| 2007/0068676 | A1 | 3/2007 | Shkurti | |
| 2007/0193741 | A1 | 8/2007 | Smith | |
| 2007/0235194 | A1* | 10/2007 | Maier | E21B 33/124 166/305.1 |
| 2008/0190605 | A1 | 8/2008 | Clapp et al. | |
| 2010/0243254 | A1 | 9/2010 | Murphy et al. | |
| 2011/0108285 | A1 | 5/2011 | Fagley, IV et al. | |
| 2011/0278016 | A1* | 11/2011 | Xu | E21B 34/10 166/373 |
| 2012/0090858 | A1 | 4/2012 | Ingram et al. | |
| 2015/0075783 | A1* | 3/2015 | Angman | E21B 43/26 166/250.01 |

OTHER PUBLICATIONS

Mongoose Frac ReNew System for Existing Completions, Multi-stage Unlimited, NCS Energy Services, Inc., 2011-2012, 1 Page.

Cost-Effective Method for Stimulating Untapped Reserves—Proved in More Than 30,000 Fracture Treatments, Halliburton, 2011, 2 Pages.

Canadian Office Action dated May 4, 2016, for Canadian Patent Application No. 2,894,839.

Australian Examination Report for Patent Application No. 2010201173 dated May 3, 2011.

Extended European Search Report; EP Application No. 10157828.4-2315; dated Oct. 24, 2012.

RoboPacker—New Solution for Coiled Tubing Fracturing and Other Applications Requiring Zonal Isolation, Depiak Indutrial Technology, Product Report, Jun. 2005.

* cited by examiner

STRADDLE PACKER SYSTEM

BACKGROUND OF THE INVENTION

Field of the Invention

Embodiments of the invention generally relate to a straddle packer system for use in a wellbore.

Description of the Related Art

A straddle packer system is used to sealingly isolate a section of a wellbore to conduct a treatment operation (for example a fracking operation) that helps increase oil and/or gas production from an underground reservoir that is in fluid communication with the isolated wellbore section. The straddle packer system is lowered into the wellbore on a work string and located adjacent to the wellbore section that is to be isolated. An upper packer of the straddle packer system is actuated into a sealed engagement with the wellbore above the wellbore section to be isolated, and a lower packer of the straddle packer system is actuated into a sealed engagement with the wellbore below the wellbore section to be isolated, thereby "straddling" the section of the wellbore to sealingly isolate the wellbore section from the sections of the wellbore above and below the upper and lower packers.

To conduct the treatment operation, pressurized fluid is supplied down through the work string and injected out of a port of the straddle packer system that is positioned between the upper and lower packers. The upper packer prevents the pressurized fluid from flowing up the wellbore past the upper packer, and the lower packer prevents the pressurized fluid from flowing down the wellbore past the lower packer. The pressurized fluid is forced into the underground reservoir that is in fluid communication with the isolated wellbore section between the upper and lower packers. The pressurized fluid is supplied at a pressure that is greater than the underground reservoir to effectively treat the underground reservoir through which oil and/or gas previously trapped in the underground reservoir can now flow.

After conducting the treatment operation, the straddle packer system can be removed from the wellbore or moved to another location within the wellbore to isolate another wellbore section. To remove or move the straddle packer system, the upper and lower packers first have to be unset from the sealed engagement with the wellbore by applying a force to the straddle packer system by pulling or pushing on the work string that is used to lower or raise the straddle packers system into the wellbore. Unsetting of the upper and lower packers of straddle packer systems, however, is difficult because a pressure differential formed across the upper and lower packers during the treatment operation continues to force the upper and lower packers into engagement with the wellbore after the treatment operation is complete.

The pressure difference is formed by the pressure on the side of the upper and lower packers that is exposed to the pressurized fluid from the treatment operation being greater than the pressure on the opposite side of the upper and lower packers that is isolated from the pressurized fluid from the treatment operation. The pressure differential forces the upper and lower packers into engagement with the wellbore and acts against the force that is applied to unset the upper and lower packers from engagement with the wellbore. Pulling or pushing on the straddle packer system via the work string while the upper and lower packers are forced into engagement with the wellbore either requires a force so large that the force will break or collapse the work string before unsetting the upper and lower packers, or causes the upper and lower packers to move while sealing against the wellbore, also known as "swabbing", which can tear and damage the upper and lower packers.

Therefore, there is a need for new and improved straddle packer systems and methods of use.

SUMMARY OF THE INVENTION

In one embodiment, a straddle packer system includes an upper seal member; a lower seal member; an upper equalizing valve configured to equalize pressure across the upper seal member; a lower equalizing valve configured to equalize pressure across the lower seal member; and an anchor.

In one embodiment, a method of operating a straddle packer system includes lowering the system into a wellbore; actuating an anchor of the system into engagement with the wellbore; energizing an upper seal member and a lower seal member of the system to isolate a section of the wellbore; equalizing pressure across the upper seal member by applying a tension force to actuate an upper equalizing valve of the system, wherein the upper seal member does not move when the upper equalizing valve is actuated by the tension force; and equalizing pressure across the lower seal member by applying the tension force to actuate a lower equalizing valve of the system, wherein the lower seal member does not move when the lower equalizing valve is actuated by the tension force.

BRIEF DESCRIPTION OF THE DRAWINGS

So that the manner in which the above recited features can be understood in detail, a more particular description, briefly summarized above, may be had by reference to the embodiments, some of which are illustrated in the appended drawings. It is to be noted, however, that the appended drawings illustrate only typical embodiments and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The embodiments of the invention are configured to equalize pressure across energized upper and lower seal members, such as packer elements or cup members, of a straddle packer system to easily move or detach the system within a wellbore. The system is configured to sealingly isolate a zone, which may be perforated, within the wellbore and allow injection of stimulation fluids into the isolated zone. Specifically, the upper and lower seal members are energized to establish a seal with the wellbore at a location above and below the zone, and then stimulation fluids are injected into the isolated zone.

The system includes an upper equalizing valve and a lower equalizing valve configured to equalize the pressure above and below the upper and lower seal members, respectively. The equalizing valves are initially in a closed position. After the upper and lower seal members are energized and the stimulation fluids are injected, the equalizing valves are sequentially actuated into an open position, e.g. the upper equalizing valve is actuated into an open position before the lower equalizing valve is actuated into an open position. Alternatively, the equalizing valves are simultaneously actuated into an open position. When the equalizing valves are in the open position, fluid communication is opened between the isolated zone and the sections of the wellbore above and below the upper and lower seal members to equalize the pressure across the upper and lower seal members. The upper and lower seal members remain engaged with the wellbore and do not move, to prevent swabbing within the wellbore, when the equalizing valves are actuated into the open position. Once the pressure is equalized, the upper and lower seal members are de-energized, which allows the system to easily move within the wellbore, and optionally be repositioned for multiple uses.

Figure 1A:
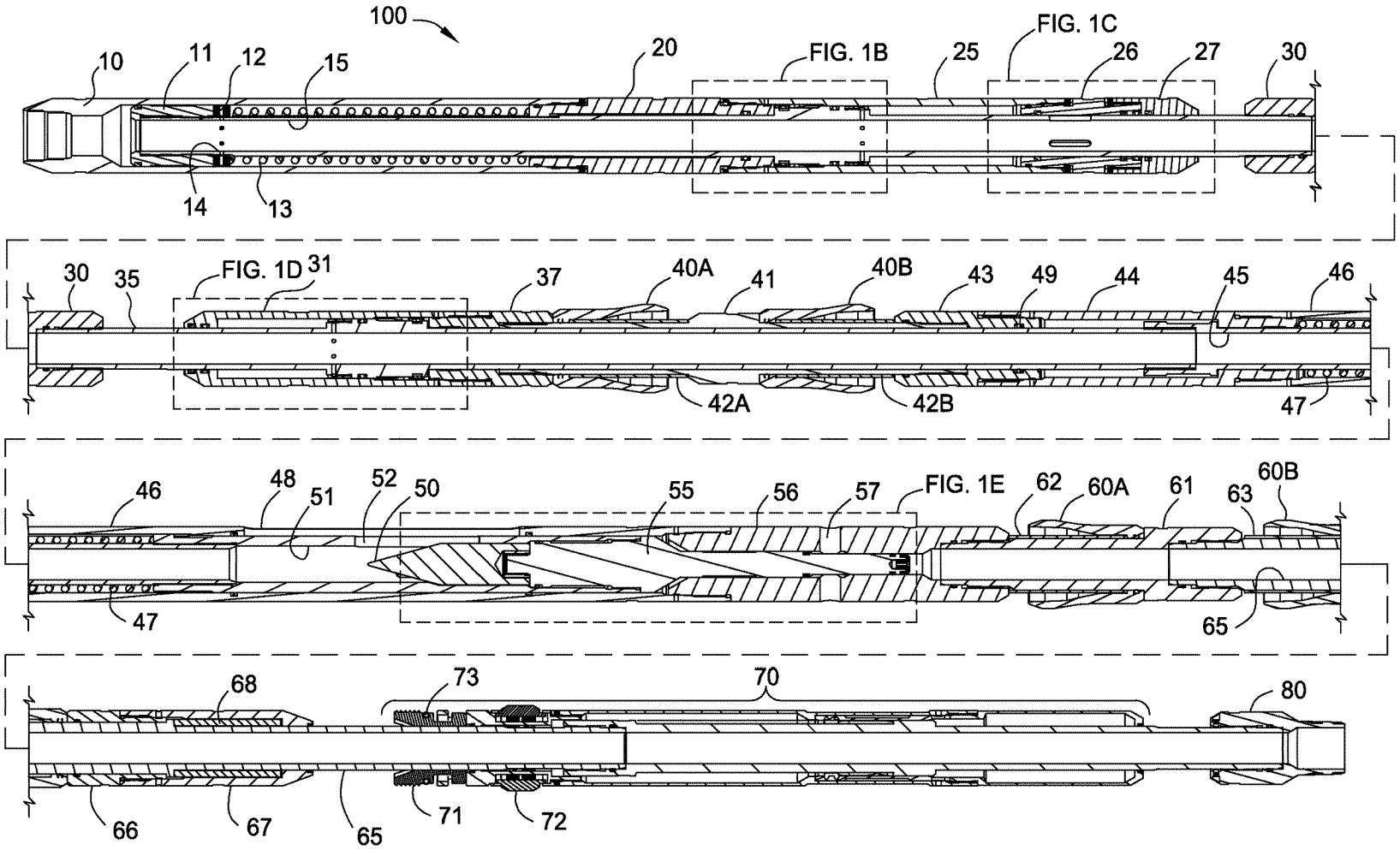
FIG. 1A illustrates a sectional view of a straddle packer system in a run-in position, according to one embodiment.

FIG. 1A illustrates a sectional view of a straddle packer system 100 in a run-in position, according to one embodiment. The system 100 can be lowered into a wellbore on a work string, such as a coiled tubing string or a threaded pipe string, in the run-in position. A compression force can be applied to the system 100 using the work string to actuate the system 100 (illustrated in FIG. 2) into engagement with the wellbore to sealingly isolate a section of the wellbore. Pressurized fluid can be supplied through the work string and injected into the isolated section of the wellbore through the system 100. A tension force can be applied to the system 100 using the work string to de-actuate the system 100 (illustrated in FIGS. 3, 4, and 5) from the sealed engagement with the wellbore.

The system 100 includes an upper housing 10 that can be coupled to a work string. The upper housing 10 is coupled to a connecting sub 20, which is coupled to a c-ring housing 25. The c-ring housing 25 is coupled to a seal sub 26, which is coupled to an end cap member 27. A first inner mandrel 15 is disposed in the upper housing 10 and extends through the connecting sub 20, the c-ring housing 25, the seal sub 26, and the end cap member 27. The components of the system 100 disposed between the upper housing 10 and the end cap member 27, including the first inner mandrel 15, generally form an upper equalizing valve of the system 100. The upper housing 10, the connecting sub 20, the c-ring housing 25, the seal sub 26, and the end cap member 27 are coupled together to form an upper outer housing of the upper equalizing valve, however, although shown as separate components, one or more of these components may be formed integral with one or more of the other components.

An adjustment member 11 is coupled to the upper end of the first inner mandrel 15 within the upper housing 10. A biasing member 13, such as a spring, is disposed within a space formed between the adjustment member 11, the first inner mandrel 15, the upper housing 10, and the connecting sub 20. One end of the biasing member 13 engages the adjustment member 11, and the opposite end of the biasing member 13 engages the connecting sub 20.

The biasing member 13 forces the adjustment member 11 and the first inner mandrel 15 in an upward direction toward the upper housing 10, which helps maintain the system 100 in the run-in position. The adjustment member 11 and the first inner mandrel 15 are movable relative to the upper housing 10, the connecting sub 20, the c-ring housing 25, the seal sub 26, and the end cap member 27 against the bias force of the biasing member 13. An optional filter member 12 is positioned between the biasing member 13 and the adjustment member 11 to filter fluid flow into the space where the biasing member 13 is located via one or more ports 14 disposed through the first inner mandrel 15.

Figure 1B:
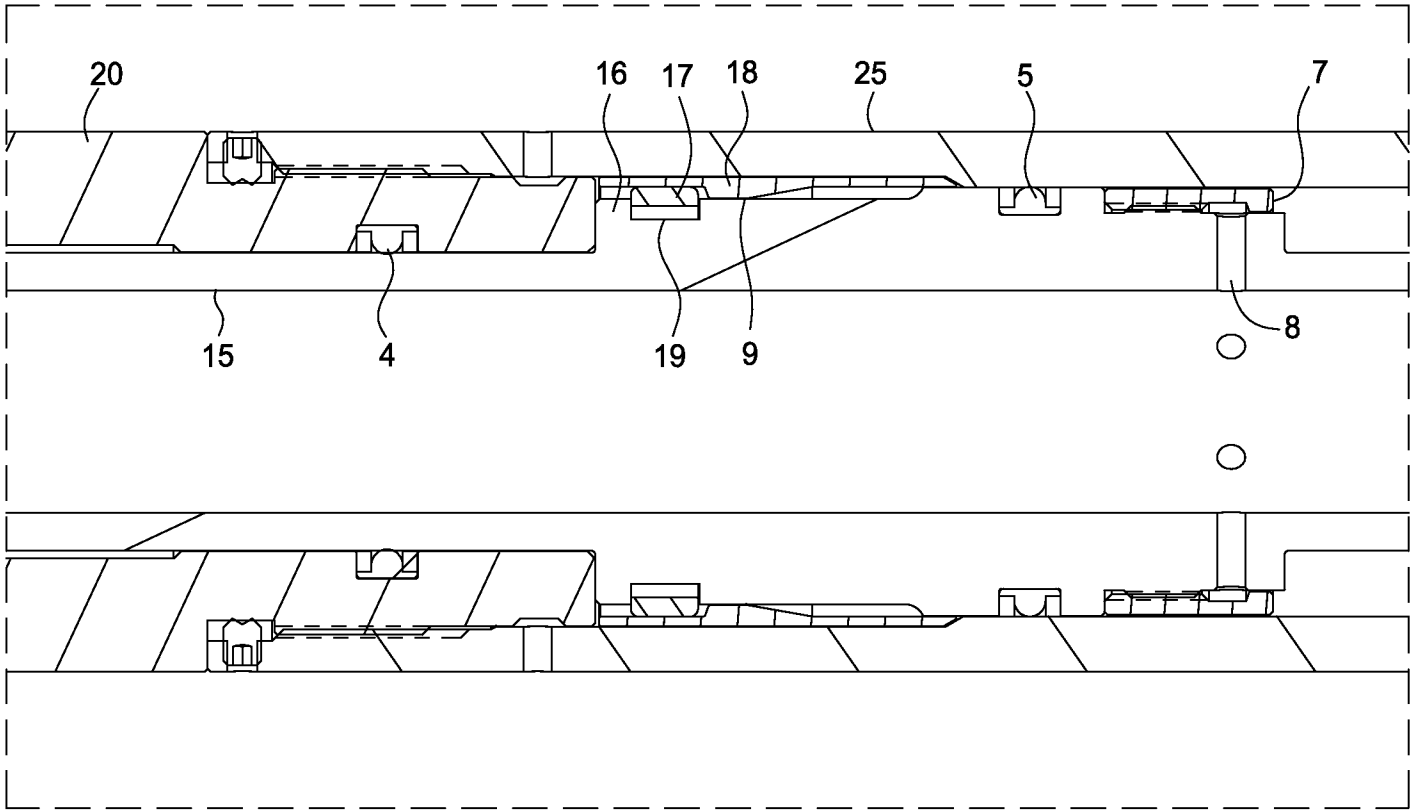
FIG. 1B illustrates an enlarged sectional view of a portion of the straddle packer system in the run-in position, according to one embodiment.

As illustrated in FIG. 1B, an outer shoulder 16 of the first inner mandrel 15 engages the lower end of the connecting sub 20. A c-ring 17 is partially disposed in a groove 19 formed in the outer shoulder 16 of the first inner mandrel 15. The c-ring 17 engages a c-ring sleeve 18, which is disposed between the outer shoulder 16 of the first inner mandrel 15 and the c-ring housing 25. A force sufficient to compress the c-ring 17 into the groove 19 against an inner shoulder 9 of the c-ring sleeve 18 is required to move the first inner mandrel 15 out of the run-in position. In this manner, the c-ring 17 and the c-ring sleeve 18 help maintain the system 100 in the run-in position. An optional filter member 7 is positioned between the first inner mandrel 15 and the c-ring housing 25 to filter fluid flow into a space formed between the first inner mandrel 15 and the c-ring housing 25 via one or more ports 8 disposed through the first inner mandrel 15.

Figure 1C:
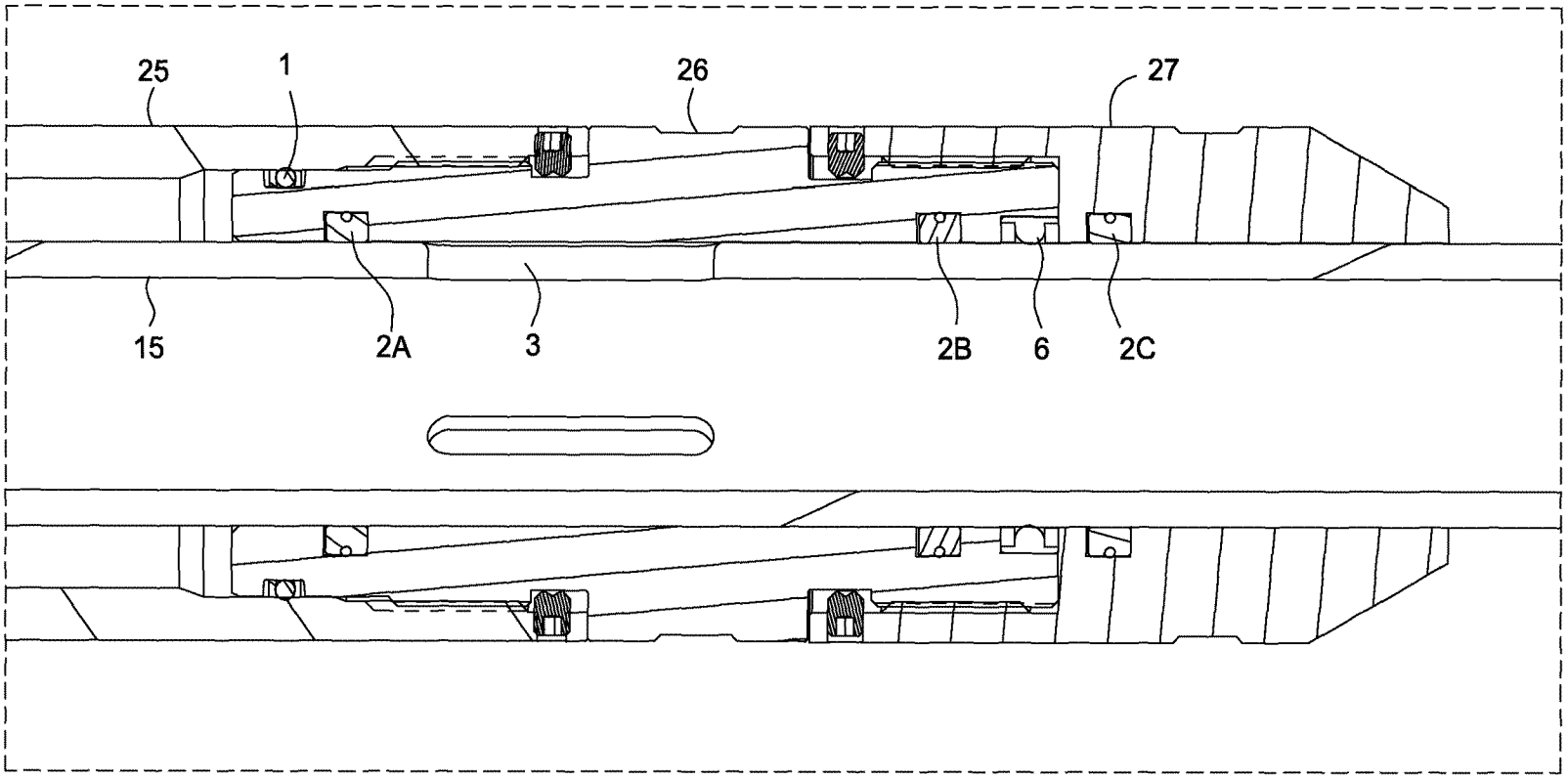
FIG. 1C illustrates an enlarged sectional view of a portion of the straddle packer system in the run-in position, according to one embodiment.

Referring to FIG. 1B and FIG. 1C, a first seal member 4 is positioned between the first inner mandrel 15 and the connecting sub 20. A second seal member 5 is positioned between the outer shoulder 16 of the first inner mandrel 15 and the c-ring housing 25. A third seal member 6 is positioned between the first inner mandrel 15 and the seal sub 26. The positions of the first, second, and third seal members 4, 5, 6 are configured to ensure that the first inner mandrel 15 remains pressure volume balanced. The seal area formed across the first seal member 4 is substantially equal to the seal area formed across the second seal member 5 minus the seal area formed across the third seal member 6. Thus, when the system 100 is pressurized, the pressurized fluid force acting on the first inner mandrel 15 in the upward direction is substantially equal to the pressurized fluid force acting on the first inner mandrel 15 in the downward direction by the pressurized fluid, e.g. pressure volume balanced. Alternatively, the positions of the first, second, and third seal members 4, 5, 6 are configured to ensure that the first inner mandrel 15 is pressure biased in the downhole direction. The seal area formed across the first seal member 4 is less than the seal area formed across the second seal member 5 minus the seal area formed across the third seal member 6. Thus, when the system 100 is pressurized, the pressurized fluid force acting on the first inner mandrel 15 in the downward direction is greater than the pressurized fluid force acting on the first inner mandrel 15 in the upward direction, resulting in the first inner mandrel 15 being biased in the downward direction by the pressurized fluid.

Further illustrated in FIG. 1B and in FIG. 1C are one or more ports 3 disposed through the first inner mandrel 15, which are positioned between wiper members 2A, 2B and within the upper outer housing of the upper equalizing valve. The third seal member 6, the wiper members 2A, 2B, and a fourth seal member 1 are supported by the seal sub 26. The third seal member 6 and the wiper members 2A, 2B are positioned between the seal sub 26 and the first inner mandrel 15. The fourth seal member 1 is positioned between the seal sub 26 and the c-ring housing 25. The first seal member 4, the second seal member 5, the third seal member 6, and the fourth seal member 1 seal and close fluid flow between the ports 3 and the surrounding wellbore annulus when the inner mandrel 15 is in the run-in position. One or more wiper members 2A, 2B, 2C can be positioned between the first inner mandrel 15, the seal sub 26, and/or end cap member 27 to remove any debris that accumulates along the outer surface of the first inner mandrel 15.

Referring back to FIG. 1A, a threaded coupling member 30 connects a lower end of the first inner mandrel 15 to an upper end of a second inner mandrel 35. The second inner mandrel 35 extends through and is movable relative to at least a top housing 31, a top connector 37, a first upper cup member 40A, an outer mandrel 41, a second upper cup member 40B, and a bottom connector 43. Other types of seal members may be used in addition to or as an alternative to the first and second upper cup members 40A, 40B, such as one or more hydraulically or mechanically set elastomeric packer elements.

The top housing 31 is coupled to the top connector 37, which is coupled to the outer mandrel 41. The first and second upper cup members 40A, 40B are supported by and disposed on the outer mandrel 41, which is coupled to the bottom connector 43. One or more spacer members 42A, 42B are positioned on the outer surface of the outer mandrel 41 and at least partially disposed within the first upper cup member 40A and the second upper cup member 40B, respectively, to space the first and second upper cup members 40A, 40B on the outer mandrel 41.

Figure 1D:
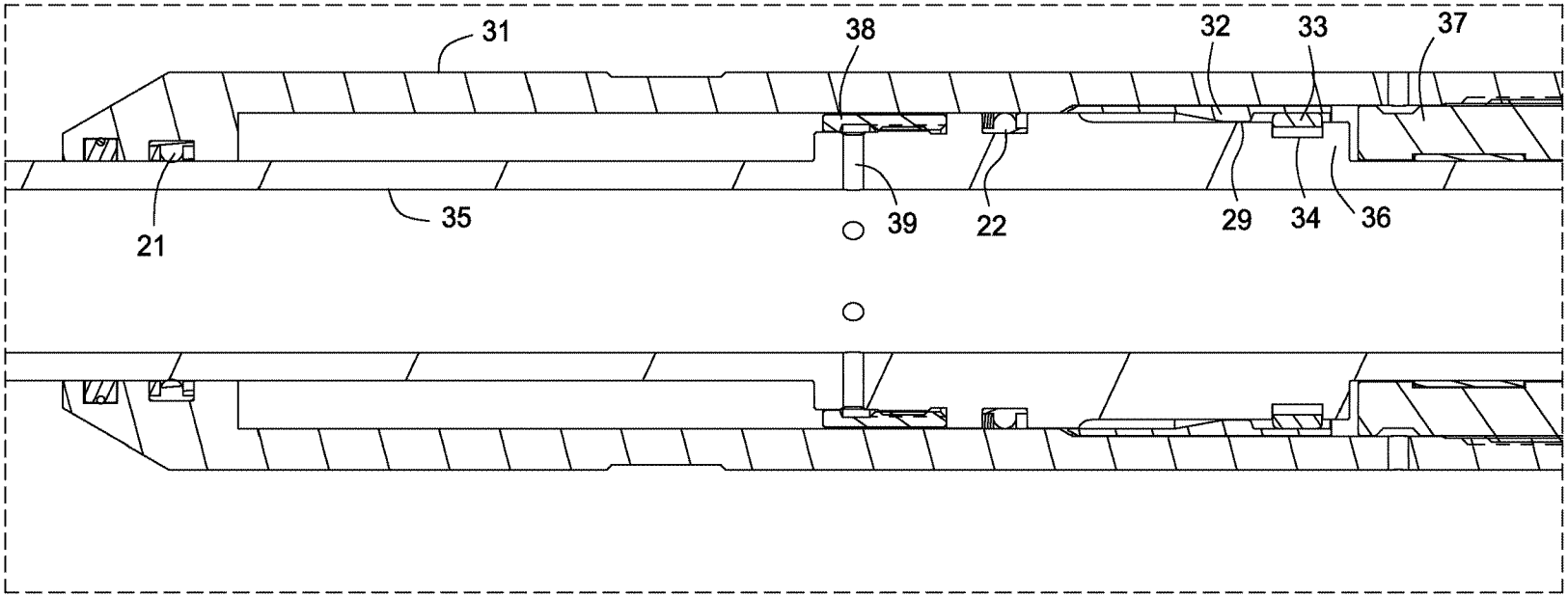
FIG. 1D illustrates an enlarged sectional view of a portion of the straddle packer system in the run-in position, according to one embodiment.

As illustrated in FIG. 1D, an outer shoulder 36 of the second inner mandrel 35 is in contact with the upper end of the top connector 37. A c-ring 33 is partially disposed in a groove 34 formed in the outer shoulder 36 of the second inner mandrel 35. The c-ring 33 engages a c-ring sleeve 32, which is disposed between the top housing 31, the second inner mandrel 35, and the top connector 37. A force sufficient to compress the c-ring 33 into the groove 34 against an inner shoulder 29 of the c-ring sleeve 32 is required to move the second inner mandrel 35 out of the run-in position. In this manner, the c-ring 33 and the c-ring sleeve 32 help maintain the system 100 in the run-in position.

A fifth seal member 21 is positioned between the second inner mandrel 35 and the top housing 31. A sixth seal member 22 is positioned between the outer shoulder 36 of the second inner mandrel 35 and the top housing 31. The seal area formed across the fifth seal member 21 is less than the seal area formed across the sixth seal member 22 so that when the system 100 is pressurized, the pressurized fluid forces the second inner mandrel 35 in the downward direction to help keep a valve member 55 (further described below) in a closed position, and to help maintain an anchor 70 (further described below) in an actuated position to secure the system 100 in the wellbore.

A seventh seal member 49 (illustrated in FIG. 1A) is positioned between the bottom connector 43 and the second inner mandrel 35. An eighth seal member 24 (illustrated in FIG. 1E) is positioned between the valve member 55 and a flow sub 56. The seal area formed across the seventh seal member 49 is greater than the seal area formed across the eighth seal member 24 so that when the system 100 is pressurized, the pressurized fluid forces the first mandrel extension 45 in the upward direction to help open the valve member 55 as further described below. However, the downward force applied to the second inner mandrel 35 generated by the fifth and sixth seal member 21, 22 is greater than the upward force acting on the first mandrel extension 45 generated by the seventh and eighth seal members 49, 24, resulting in the second inner mandrel 35 and the first mandrel extension 45 being biased in the downward direction when the system 100 is initially pressurized.

Alternatively, the positions of the fifth, sixth, seventh, and eighth seal members 21, 22, 49, 24 are configured to ensure that the second inner mandrel 35, the first mandrel extension 45, an inner flow sleeve 51, and the valve member 55 are pressure volume balanced so that when the system 100 is pressurized the sum of the forces on these components are in equilibrium such that these components remain in the run-in position and do not move in the upward or downward direction. Specifically, the downward force acting on the second inner mandrel 35 generated by the fifth and sixth seal members 21, 22 is substantially equal to the upward force acting on the first mandrel extension 45 generated by the seventh and eight seal members 49, 24, e.g. pressure volume balanced.

Alternatively still, the positions of the fifth, sixth, seventh, and eighth seal members 21, 22, 49, 24 are configured to ensure that the second inner mandrel 35, the first mandrel extension 45, the inner flow sleeve 51, and the valve member 55 are pressure biased in the upward direction. Specifically, the downward force acting on the second inner mandrel 35 generated by the fifth and sixth seal members 21, 22 is less than the upward force acting on the first mandrel extension 45 generated by the seventh and eight seal members 49, 24, resulting in the second inner mandrel 35, the first mandrel extension 45, the inner flow sleeve 51, and the valve member 55 being biased in the upward direction when the system 100 is initially pressurized. Optionally, a hold down sub can be added to the coupling member 30 to counteract the upward force acting on the second inner mandrel 35, the first mandrel extension 45, the inner flow sleeve 51, and the valve member 55.

An optional filter member 38 (illustrated in FIG. 1D) is positioned between the second inner mandrel 35 and the top housing 31 to filter fluid flow into a space formed between the second inner mandrel 35 and the top housing 31 and between the fifth and sixth seal members 21, 22 via one or more ports 39 disposed through the second inner mandrel 35.

Referring back to FIG. 1A, the second inner mandrel 35 is coupled to the first mandrel extension 45, which is coupled to the inner flow sleeve 51 having one or more ports 52. The inner flow sleeve 51 is coupled to the valve member 55. The second inner mandrel 35 and the first mandrel extension 45 are at least partially disposed within a mandrel housing 44, which is coupled to the lower end of the bottom connector 43. The mandrel housing 44 is coupled to an outer flow sleeve 46 having one or more ports 48, which is coupled to a flow sub 56. The components of the system 100 disposed between the bottom connector 43 and the flow sub 56, including the second inner mandrel 35, generally form a lower equalizing valve of the system 100. The bottom connector 43, the mandrel housing 44, the outer flow sleeve 46, and the flow sub 56 are coupled together to form a lower outer housing of the lower equalizing valve, however, although shown as separate components, one or more of these components may be formed integral with one or more of the other components.

The flow sub 56 has one or more ports 57, through which fluid flow is open and closed by the valve member 55. The upper end of the inner flow sleeve 51 includes a splined engagement with the outer flow sleeve 46 that rotationally couples the inner flow sleeve 51 to the outer flow sleeve 46 but allows relative axial movement between the inner flow sleeve 51 and the outer flow sleeve 46. A flow diverter 50 is coupled to an upper end of the valve member 55 to divert fluid flow toward the ports 52 formed in the inner flow sleeve 51 and the ports 48 formed in the outer flow sleeve 46.

A biasing member 47, such as a spring, is disposed within a space formed between the mandrel housing 44, the first mandrel extension 45, the outer flow sleeve 46, and the inner flow sleeve 51. One end of the biasing member 47 engages the mandrel housing 44, and the opposite end of the biasing member 47 engages the inner flow sleeve 51 to bias the inner flow sleeve 51 and the valve member 55 into the run-in position to close fluid flow through the ports 57 of the flow sub 56. The second inner mandrel 35, the first mandrel extension 45, the inner flow sleeve 51, the valve member 55, and the flow diverter 50 are movable in an upward direction relative to at least the bottom connector 43, the mandrel housing 44, the outer flow sleeve 46 and the flow sub 56 against the bias force of the biasing member 47.

Figure 1E:
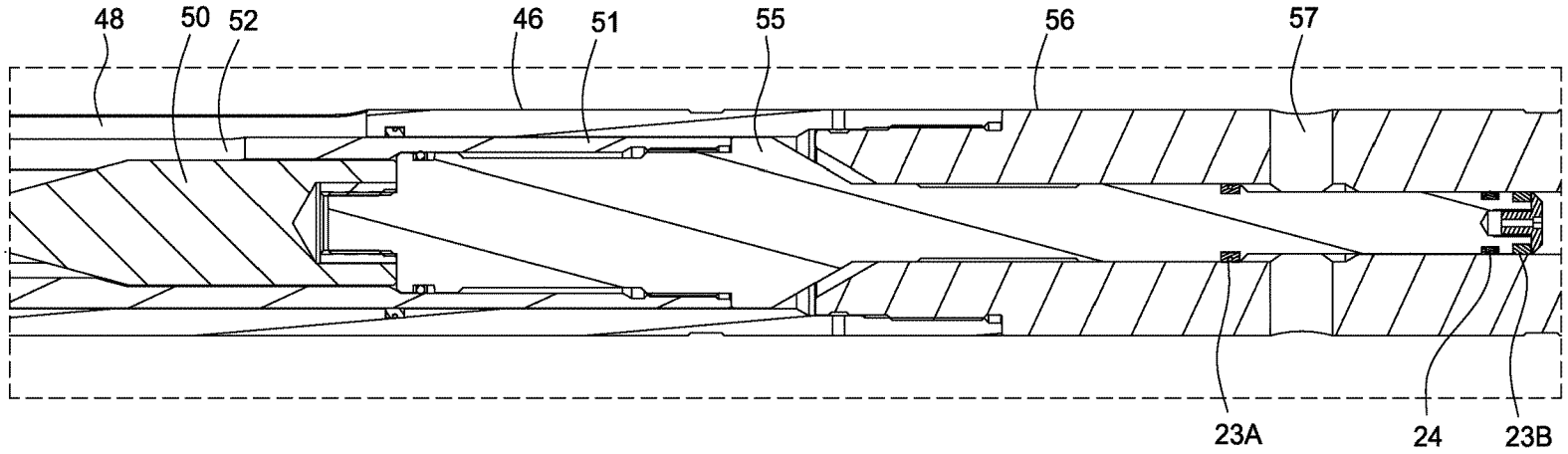
FIG. 1E illustrates an enlarged sectional view of a portion of the straddle packer system in the run-in position, according to one embodiment.

FIG. 1E illustrates the diverter 50 coupled to the upper end of the valve member 55 within the inner flow sleeve 51. The valve member 55 has a larger outer diameter portion that engages the upper end of the flow sub 56. The valve member 55 also has a smaller outer diameter portion that extends into the bore of the flow sub 56 and supports wiper members 23A, 23B and the eighth seal member 24, which seals off fluid flow through the ports 57 of the flow sub 56 when the system 100 is in the run-in position.

Referring back to FIG. 1A, the lower end of the flow sub 56 is coupled to the upper end of a second mandrel extension 61, which is coupled to a third inner mandrel 65. A first lower cup member 60A is supported by and disposed on the second mandrel extension 61. A second lower cup member 60B is supported by and disposed on the third inner mandrel 65. A spacer member 62 is positioned between the first lower cup member 60A and the flow sub 56. Another spacer member 63 is positioned between the second lower cup member 60B and the second mandrel extension 61. Other types of seal members may be used in addition to or as an alternative to the first and second lower cup members 60A, 60B, such as one or more hydraulically or mechanically set elastomeric packer elements.

A lower ring member 66 is positioned below the second lower cup member 60B, and is coupled to a cone member 67. A loading sleeve 68 is disposed between the cone member 67 and the third inner mandrel 65. The lower end of the third inner mandrel 65 extends through the lower ring member 66 and the cone member 67, and is coupled to an anchor 70 having one or more slips 71 and one or more drag blocks 72. The slips 71 are biased radially inward by a biasing member 73, such as a spring, and are actuated radially outward by the cone member 67 to engage the walls of the wellbore to secure the system 100 in the wellbore. The drag blocks 72 provide a frictional resistant against the walls of the wellbore to allow the system 100 to be raised and lowered relative to the anchor 70 to actuate the slips 71, such as by using a j-slot profile of the anchor 70. The anchor 70 is coupled to a bottom sub 80, which provides a threaded connection to one or more other tools that can be used in the wellbore.

The anchor 70 can include any type of wellbore anchoring device that can be operated using mechanical, hydraulic, and/or electrical actuation and de-actuation. An example of a wellbore anchoring device that can be used as the anchor 70 is an anchor 600 described and illustrated in US Patent Application Publication No. 2011/0108285, the contents of which are herein incorporated by reference in its entirety. Another example of wellbore anchoring devices that can be used as the anchor 70 are anchors 500, 600 described and illustrated in US Patent Application Publication No. 2010/0243254, the contents of which are herein incorporated by reference in its entirety.

While the system 100 is lowered into the wellbore using a work string, a fluid can be circulated down the annulus of the wellbore, e.g. the space between the outer surface of the work string and the inner surface of the wellbore. The fluid will flow freely past the first and second upper cup members 40A, 40B, and through the ports 48, 52 into the system 100. The fluid will flow through the flow bore of the system 100, e.g. through the flow bores of the inner flow sleeve 51, the first mandrel extension 45, the second inner mandrel 35, the first inner mandrel 15, and the upper housing 10, and then back up to the surface through the work string. The lower cup members 60A, 60B prevent the fluid from flowing down through the annulus past the lower cup members 60A, 60B. The valve member 55 prevents the fluid from flowing down through the lower end of the system 100.

Figure 2:
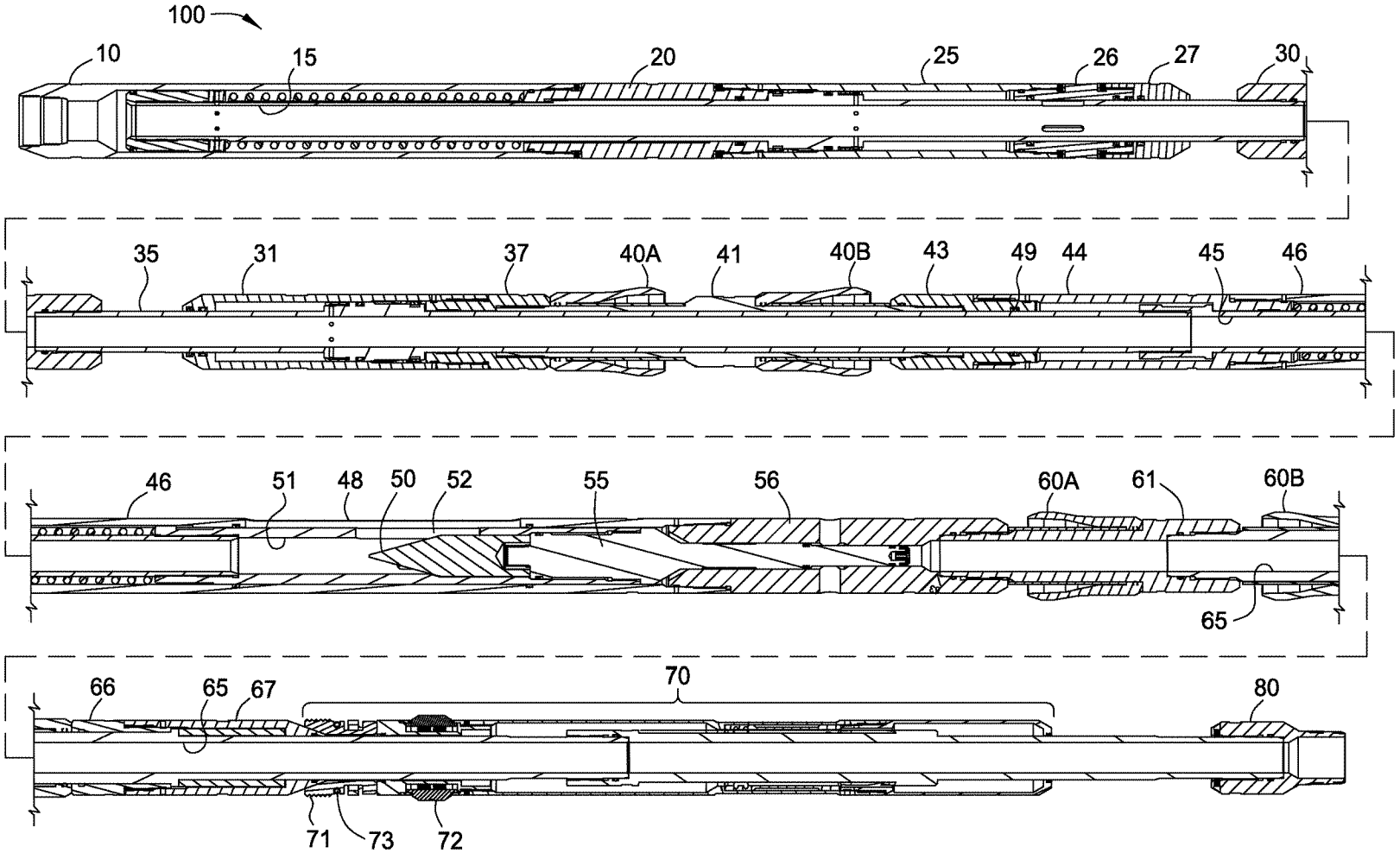
FIG. 2 illustrates a sectional view of the straddle packer system in a set position, according to one embodiment.

FIG. 2 illustrates a sectional view of the straddle packer system 100 in a set position, according to one embodiment. The system 100 is positioned in the wellbore so that the upper cup members 40A, 40B are located above a zone of the wellbore to be isolated, and so that the lower cup members 60A, 60B are located below the zone to be isolated. When in the desired position, the system 100 may be slightly raised and/or lowered, e.g. reciprocated, one or more times using the work string to actuate the anchor 70. For example, the anchor 70 can include a j-slot profile configured to control actuation and de-actuation of the anchor 70 as the work string is raised and/or lowered. The drag blocks 72 of the anchor 70 provide the frictional resistance necessary to allow the components of the system 100 to be slightly raised and/or lowered relative to the anchor 70.

As illustrated in FIG. 2, a compression force, such as the weight of the work string, is applied to or set down on the system 100 to move the components of the system 100 in a downward direction relative to the anchor 70. The compression force moves the cone member 67 into engagement with the slips 71 of the anchor 70. The cone member 67 forces the slips 71 radially outward against the bias of the biasing member 73 and into engagement with the wellbore to secure the system 100 in the wellbore.

In one embodiment, one or more compression or tension set lower seal members, such as elastomeric packing elements, can be used instead of the first and second lower cup members 60A, 60B. The compression force provided by the weight of the work string can also actuate the lower seal members into sealing engagement with the wellbore. The tension can be provided by pulling on the work string to actuate the lower seal members into sealing engagement with the wellbore. The lower seal members can be actuated at substantially the same time or subsequent to actuation of the anchor 70.

A pressurized fluid can be pumped down through the work string into the flow bore of the system 100, and injected out of the system 100 through the ports 48, 52 into the isolated zone in the wellbore. The diverter 50 helps divert the pressurized fluid out through the ports 48, 52, and the valve member 55 prevents the pressurized fluid from flowing down through the lower end of the system 100. The first and/or second upper cup members 40A, 40B are energized into sealed engagement by the pressurized fluid and prevent the pressurized fluid from flowing up the annulus past the first and/or second upper cup members 40A, 40B. The first and/or second lower cup members 60A, 60B are also energized into sealed engagement by the pressurized fluid and prevent the pressurized fluid from flowing down the annulus past the first and/or second lower cup members 60A, 60B.

After the pressurized fluid is injected into the isolated zone and/or when desired, the pressure across the first and/or second upper cup members 40A, 40B can be equalized using the upper equalizing valve of the system 100, and then the pressure across the first and/or second lower cup members 60A, 60B can be equalized using the lower equalizing valve of the system 100. The components of the system 100 disposed between the upper housing 10 and the end cap member 27, including the first inner mandrel 15, generally form the upper equalizing valve of the system 100. The components of the system 100 disposed between the bottom connector 43 and the flow sub 56, including the second inner mandrel 35, generally form the lower equalizing valve of the system 100.

Figure 3:
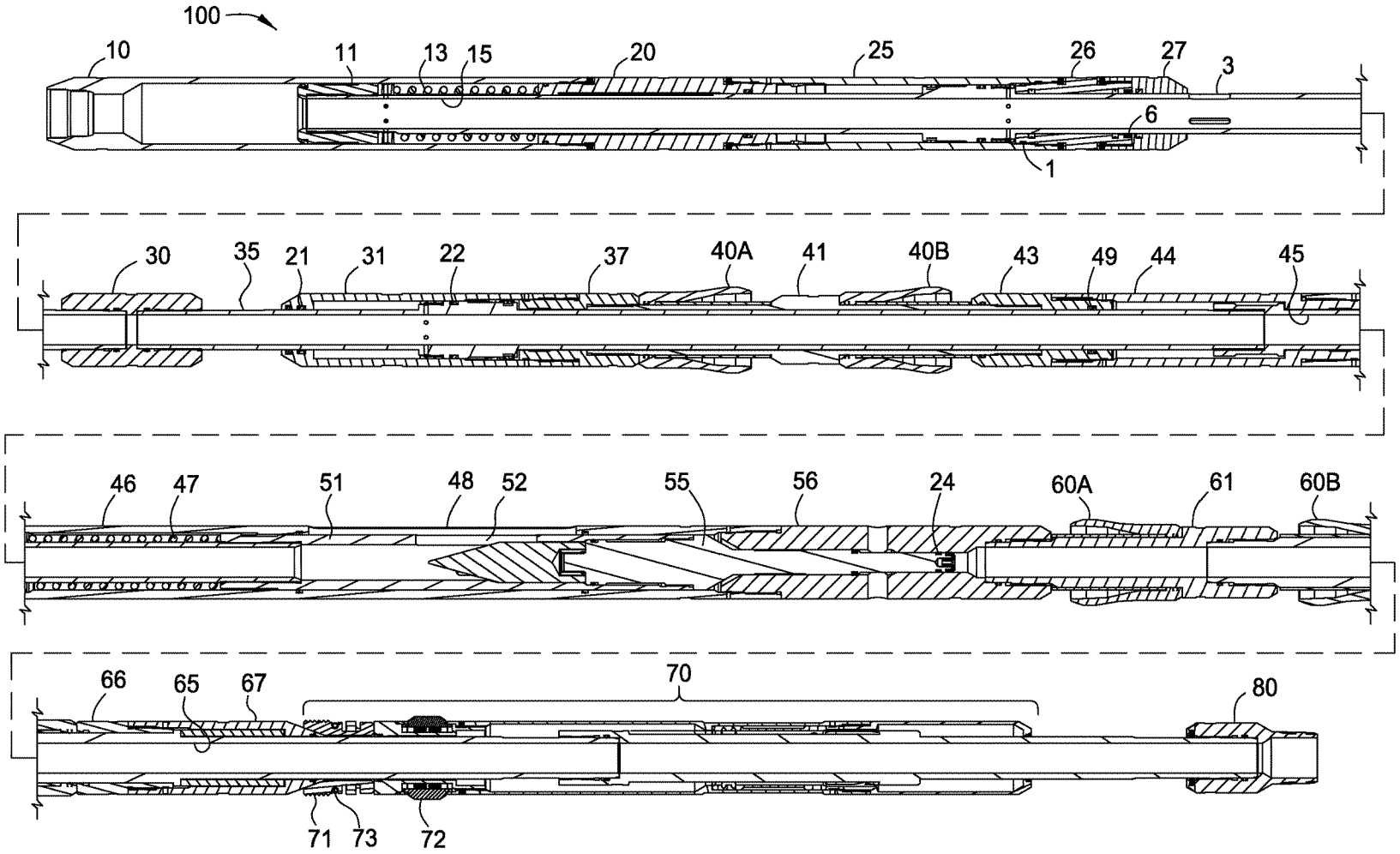
FIG. 3 illustrates a sectional view of the straddle packer system in a first unloading position, according to one embodiment.

FIG. 3 illustrates a sectional view of the straddle packer system 100 in a first unloading position to equalize the pressure across the first and/or second upper cup members 40A, 40B using the upper equalizing valve of the system 100. As illustrated in FIG. 3, a tension force can be applied to the system 100 using the work string to open fluid communication through the ports 3 in the inner mandrel 15. The tension force will pull the upper housing 10, the connecting sub 20, the c-ring housing 25, the seal sub 26, and the end cap member 27 in an upward direction relative to the first inner mandrel 15, which is secured in the wellbore by the anchor 70. The tension force must be sufficient to compress the biasing member 13 between the adjustment member 11 and the upper end of the connecting sub 20. The tension force must also be sufficient to force the shoulder 9 of the c-ring sleeve 18 across the c-ring 17 (as illustrated in FIG. 1B) and compress the c-ring 17 into the groove 19 to move the upper housing 10 in the upward direction relative to the first inner mandrel 15.

The third seal member 6 is moved with the seal sub 26 to a position that opens fluid communication between the upper annulus surrounding the system 100 and the flow bore of the system 100 through the ports 3 of the first inner mandrel 15, as illustrated in FIG. 3. The ports 3 are positioned outside of the end cap member 27 of the upper equalizing valve to open fluid communication to the annulus surrounding the system 100. Pressure above and below the first and/or second upper cup members 40A, 40B is equalized since the annulus above and below the first and/or second upper cup members 40A, 40B are in fluid communication through the flow bore of the system 100 via the ports 3 in the inner mandrel 15 and the ports 48, 52 in the outer and inner flow sleeves 46, 51. The first and/or second upper cup members 40A, 40B are not moved when equalizing the pressure across the first and/or second upper cup members 40A, 40B to prevent swabbing within the wellbore. When the pressure is equalized across the first and/or second upper cup members 40A, 40B, the downward force acting on the second inner mandrel 35 generated by the fifth and sixth seal members 21, 22 is removed or reduced to an amount less than the upward force acting on the first mandrel extension 45 generated by the seventh and eighth seal members 49, 24, resulting in the upward force assisting with equalizing the pressure across the first and/or second lower cup members 60A, 60B as illustrated in FIG. 4.

Figure 4:
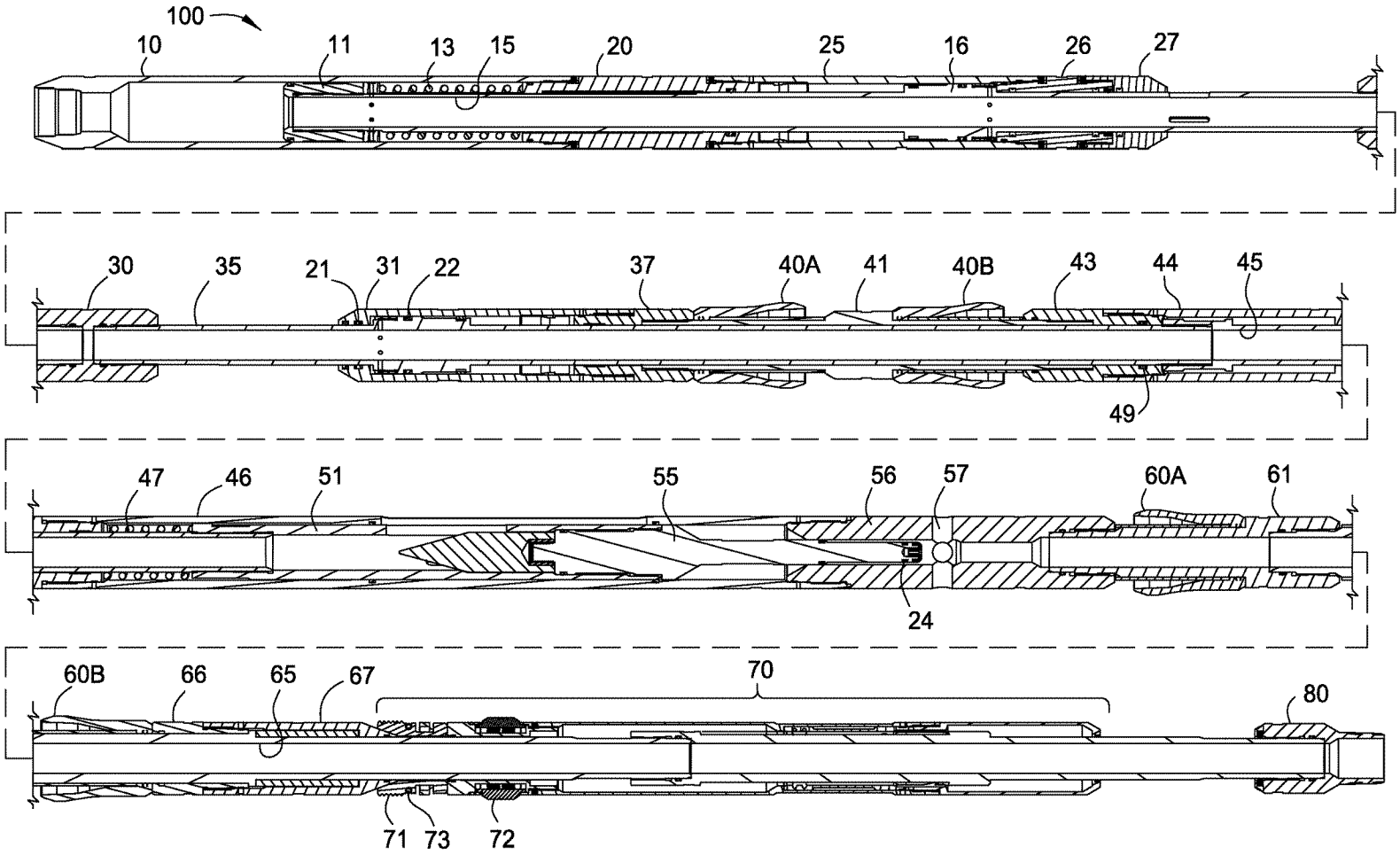
FIG. 4 illustrates a sectional view of the straddle packer system in a second unloading position, according to one embodiment.

FIG. 4 illustrates a sectional view of the straddle packer system 100 in a second unloading position to equalize the pressure across the first and/or second lower cup members 60A, 60B using the lower equalizing valve of the system 100 by opening fluid communication through the ports 57 of the flow sub 56. As illustrated in FIG. 4, the tension force can continue to be applied to the system 100 using the work string until the upper end of the seal sub 26 engages the shoulder 16 of the first inner mandrel 15, which transmits the tension force to the first inner mandrel 15. The tension force is then transmitted from the first inner mandrel 15 to the second inner mandrel 35 via the coupling member 30.

The tension force transmitted to the second inner mandrel 35 pulls the first extension member 45, the inner flow sleeve 51, and the valve member 55 in an upward direction relative to the top housing 31, the top connector 37, the first lower cup member 40A, the outer mandrel 41, the second lower cup member 40B, the bottom connector 43, the mandrel housing 44, the outer flow sleeve 46, and the flow sub 56, which are secured in the wellbore by the anchor 70. The tension force must be sufficient to compress the biasing member 47 between the mandrel housing 44 and the upper end of the inner flow sleeve 51. The tension force must also be sufficient to force the c-ring 33 across the shoulder 29 of the c-ring sleeve 32 (as illustrated in FIG. 1D) to move the second inner mandrel 35 in the upward direction relative to the top housing 31.

The eighth seal member 24 is moved with the valve member 55 to a position that opens fluid communication between the annulus surrounding the system 100 and the flow bore of the system 100 through the ports 57 of the flow sub 56. Pressure above and below the first and/or second lower cup members 60A, 60B is equalized since the annulus above and below the first and/or second lower cup members 60A, 60B are in fluid communication through the flow bore of the system 100 via the ports 57 in the flow sub 56 and out through the bottom sub 80 at the lower end of the system 100. The first and/or second lower cup members 60A, 60B are not moved when equalizing the pressure across the first and/or second lower cup members 60A, 60B to prevent swabbing within the wellbore or breaking of the work string.

The tension force transmitted to the first extension member 45 by the second inner mandrel 35 moves the first extension member 45 in an upward direction and into engagement with the lower end of the bottom connector 43. The upward force is then transmitted from the bottom connector 43 to the mandrel housing 44, the outer flow sleeve 46, the flow sub 56, the second mandrel extension 61, the third inner mandrel 65, the lower ring member 66, and the cone member 67. The upward force moves the cone member 67 away from the anchor 70 (shown in FIG. 5) and from underneath the slips 71 to allow the biasing member 73 to retract the slips 71 radially inward from engagement with the wellbore. Alternatively, the anchor 70 can then be de-actuated using another mechanical force and/or a hydraulic force to release the system 100 from the wellbore. The system 100 can then be moved to another location within the wellbore and operated as described above.

Figure 5:
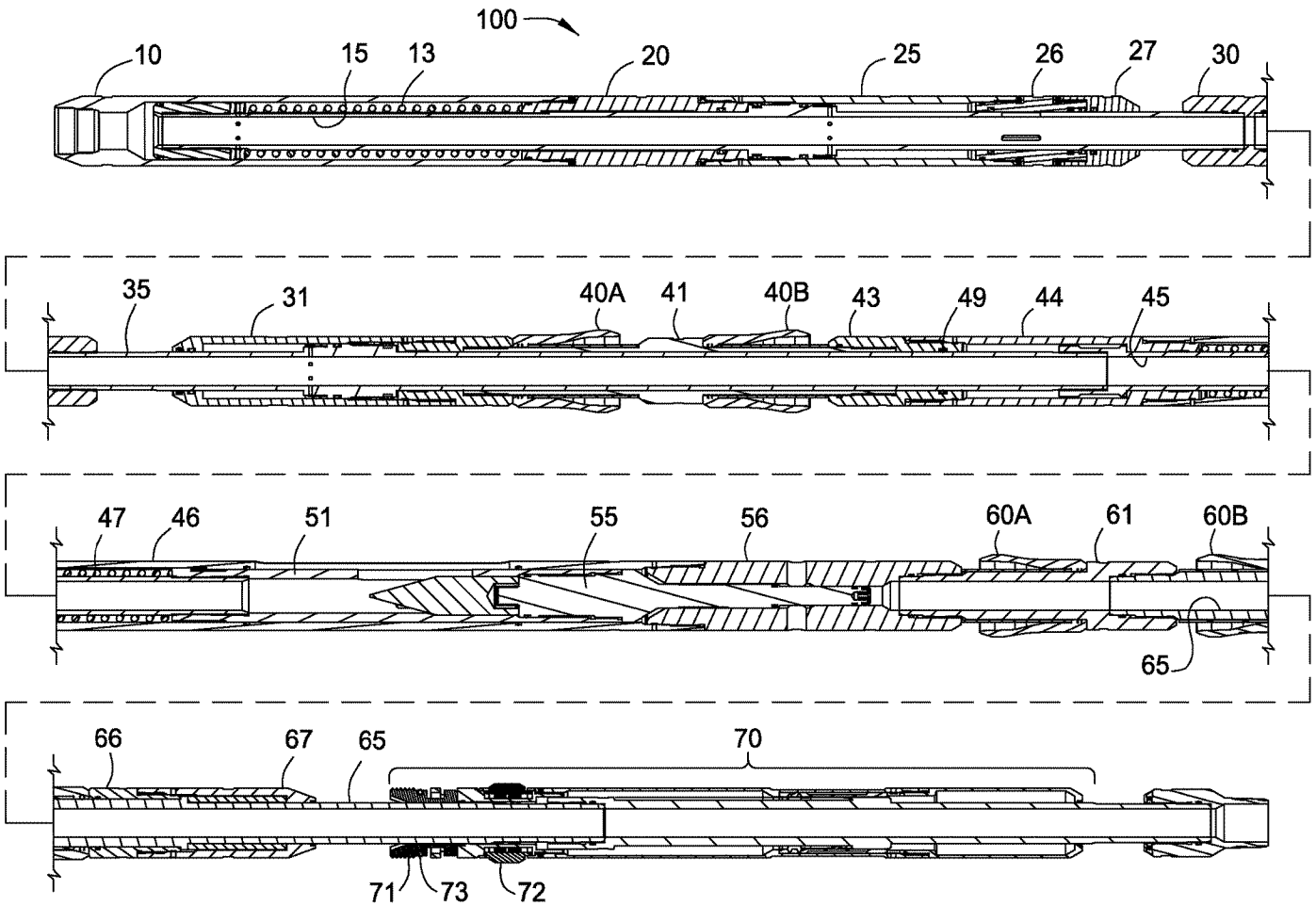
FIG. 5 illustrates a sectional view of the straddle packer system in an unset position, according to one embodiment.

FIG. 5 illustrates a sectional view of the straddle packer system 100 in an unset position, according to one embodiment. The tension force applied to the work string can be released and/or a compression force, such as the weight of the work string, can be set down on the system 100 to unset the first and second upper and/or lower packers 40A, 40B, 60A, 60B. The biasing member 13 can assist in moving at least the connecting sub 20, the c-ring housing 25, the seal sub 26, and the end cap member 27 back to the run-in position as illustrated in FIG. 1. The biasing member 47 can also assist in moving at least the inner flow sleeve 51 and the valve member 55 back to the run-in position as illustrated in FIG. 1.

Figure 6:
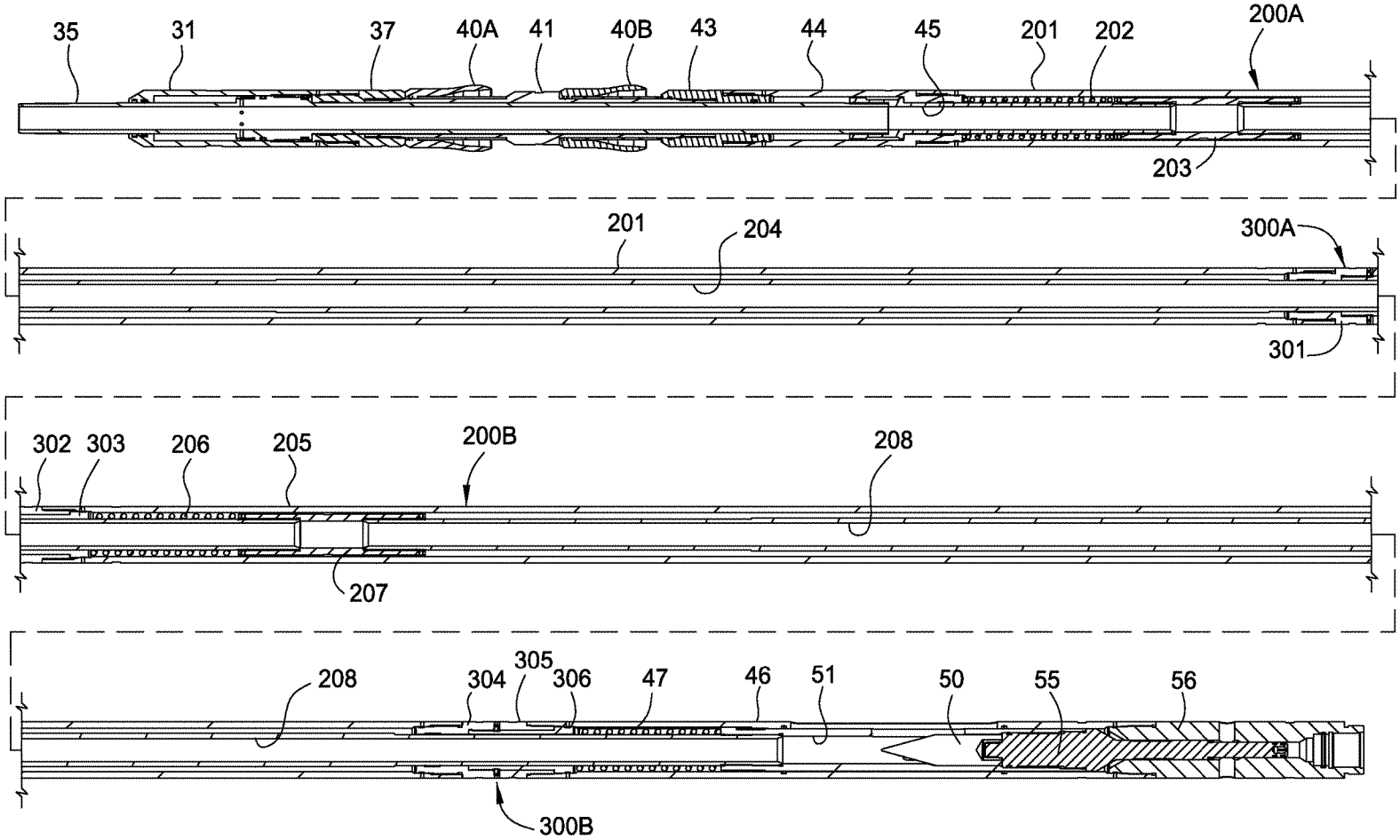
FIG. 6 illustrates a sectional view of two spacer pipe couplings and two swivels for use with the straddle packer system, according to one embodiment.

FIG. 6 illustrates a sectional view of two spacer pipe couplings 200A, 200B and two swivels 300A, 300B for use with the straddle packer system 100, according to one embodiment. The spacer pipe couplings 200A, 200B and the swivels 300A, 300B are a modular design such that any number of spacer pipe couplings 200A, 200B and swivels 300A, 300B can be used to extend the length of and easily connect the straddle packer system 100 components together. Only the portion of the straddle packer system 100 that is coupled together using the spacer pipe couplings 200A, 200B and the swivels 300A, 300B is illustrated in FIG. 6. The spacer pipe couplings 200A, 200B can be used with the straddle packer system 100 to increase the distance between the first and second upper cup members 40A, 40B and the first and second lower cup members 60A, 60B (shown in FIG. 1) depending on the size of the section of wellbore to be isolated using the straddle packer system 100. The swivels 300A, 300B are used to easily connect the spacer pipe couplings 200A, 200B together and/or to connect the spacer pipe couplings 200A, 200B to the straddle packer system 100 without having to rotate the spacer pipe couplings 200A, 200B or the straddle packer system 100. Rather the swivels 300A, 300B rotate to make up the connections there between. When connected, the swivels 300A, 300B transmit rotation from the work string to the section of the system 100 below the first and second upper cup members 40A, 40B.

As illustrated in FIG. 6, each spacer pipe coupling 200A, 200B includes an outer spacer pipe 201, 205, a biasing member 202, 206, a coupling member 203, 207, and an inner spacer pipe 204, 208, respectively.

Regarding the spacer pipe coupling 200A, the upper end of the outer spacer pipe 201 is coupled to the lower end of the mandrel housing 44. The lower end of the outer spacer pipe 201 is coupled to the upper end of the swivel 300A. The upper end of the inner spacer pipe 204 is coupled to the coupling member 203, which is coupled to the lower end of the first mandrel extension 45. The biasing member 202 is disposed between the lower end of the mandrel housing 44 and the upper end of the coupling member 203 to help bias the system 100 in the run-in position as illustrated in FIG. 1. The lower end of the inner spacer pipe 204 extends through the swivel 300A and is coupled to the upper end of the coupling member 207.

Regarding the spacer pipe coupling 200B, the upper end of the outer spacer pipe 205 is coupled to the lower end of the swivel 300A. The lower end of the outer spacer pipe 205 is coupled to the upper end of the swivel 300B. The upper end of the inner spacer pipe 208 is coupled to the coupling member 207, which is coupled to the lower end of the inner spacer pipe 204. The biasing member 206 is disposed between the lower end of the swivel 300A and the upper end of the coupling member 207 to help bias the system 100 in the run-in position as illustrated in FIG. 1. The lower end of the inner spacer pipe 208 extends through the swivel 300B and is coupled to the upper end of the inner flow sleeve 51.

An upward tension force applied to the second inner mandrel 35 is transmitted to the first mandrel extension 45, which is transmitted to the coupling member 203, the inner spacer pipe 204, the coupling member 207, and the inner spacer pipe 208 to move the inner flow sleeve 51 and the valve member 55 to the second unloading position as described above with respect to FIG. 4. The first mandrel extension 45, the coupling member 203, the inner spacer pipe 204, the coupling member 207, and the inner spacer pipe 208 are movable relative to the swivels 300A, 300B.

As illustrated in FIG. 6, each swivel 300A, 300B includes an upper connector 301, 304, a lower connector 302, 305, and an inner mandrel 303, 306, respectively.

Regarding the swivel 300A, the upper end of the upper connector 301 is coupled to the lower end of the outer spacer pipe 201. The lower end of the upper connector 301 is coupled to the upper end of the inner mandrel 303. The lower connector 302 is disposed between the lower end of the upper connector 301 and an outer shoulder of the inner mandrel 303. The lower connector 302 is coupled to the upper end of the outer spacer pipe 205. Rotation from the outer spacer pipe 201 can be transmitted to the outer spacer pipe 205 via the swivel 300A.

Regarding the swivel 300B, the upper end of the upper connector 304 is coupled to the lower end of the outer spacer pipe 205. The lower end of the upper connector 304 is coupled to the upper end of the inner mandrel 306. The lower connector 305 is disposed between the lower end of the upper connector 304 and an outer shoulder of the inner mandrel 306. The lower connector 305 is coupled to the upper end of the outer flow sleeve 46. The biasing member 47 is disposed between the lower end of the inner mandrel 306 and the upper end of the inner flow sleeve 51. Rotation from the outer spacer pipe 205 can be transmitted to the outer flow sleeve 46 via the swivel 300B.

Although only two spacer pipe couplings 200A, 200B and two swivels 300A, 300B are illustrated, any number of spacer pipe couplings and swivels can be used with the system 100 described above.

Figure 7:
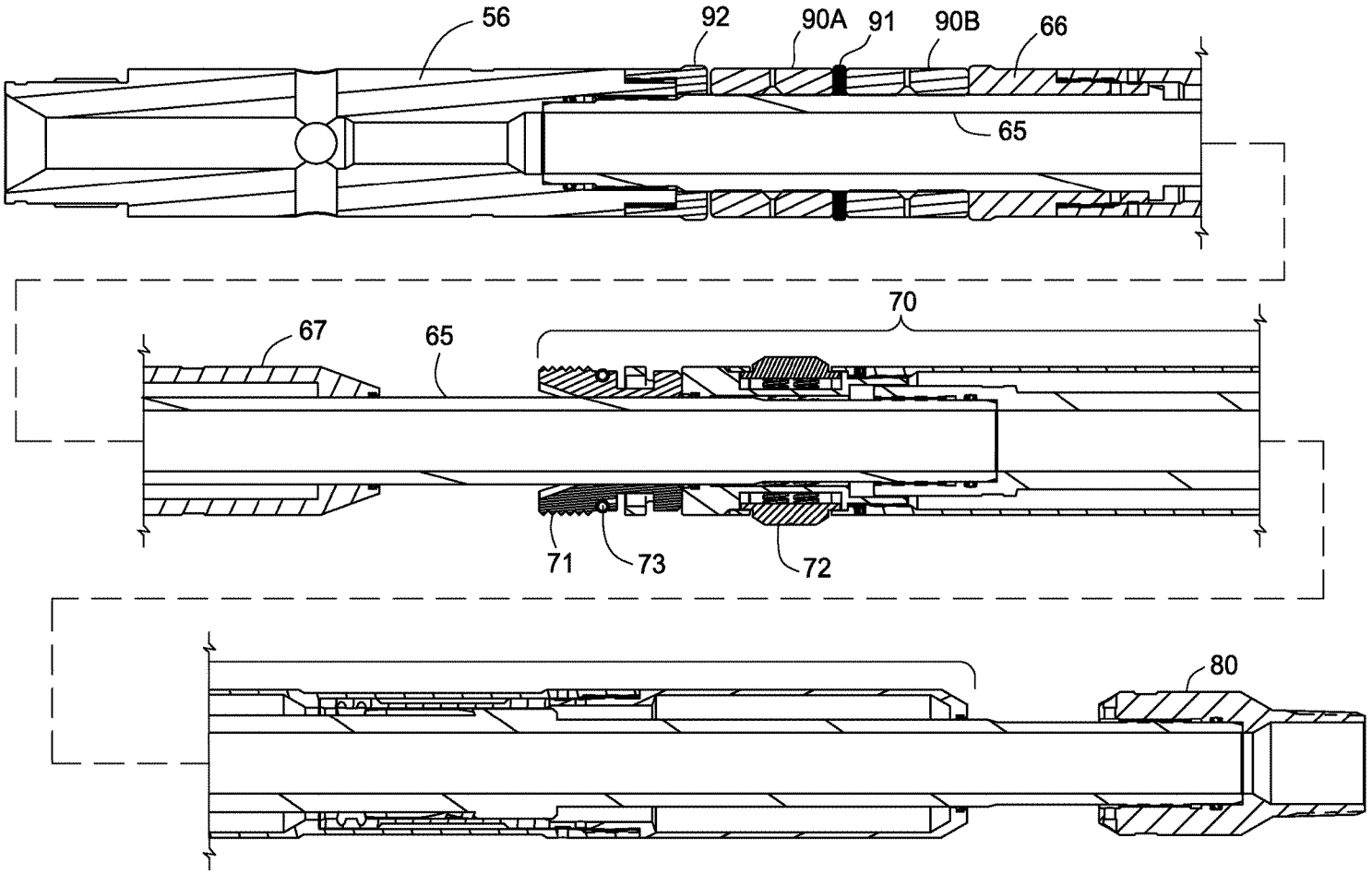
FIG. 7 illustrates a sectional view of a lower packer element of the straddle packer system in an unset position, according to one embodiment.
Figure 8:
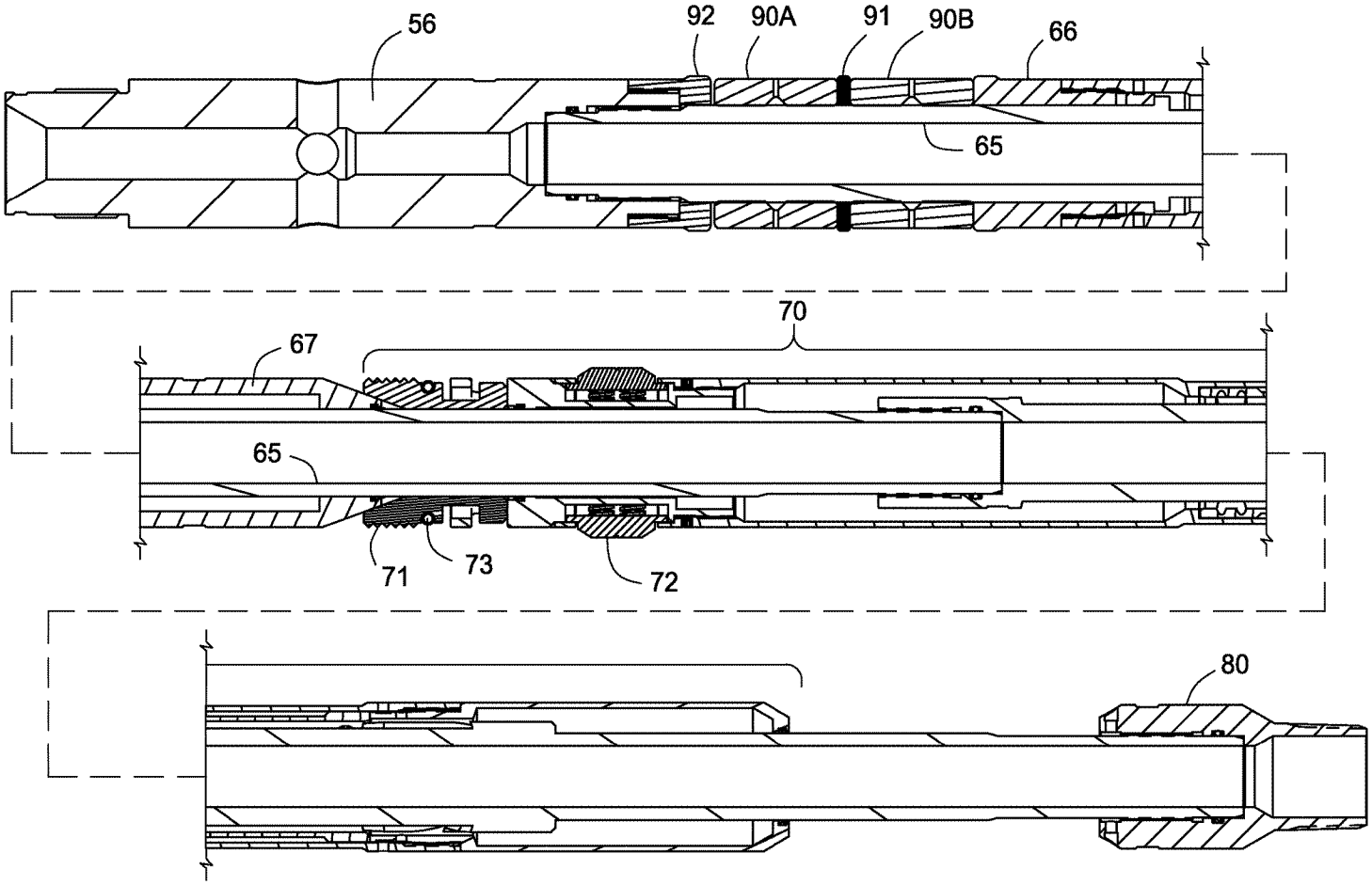
FIG. 8 illustrates a sectional view of the lower packer element of the straddle packer system in a set position, according to one embodiment.

FIGS. 7 and 8 illustrate unset and set positions, respectively, of lower packer elements 90A, 90B (e.g. seal members) that can be used as an alternative to the first and second lower cup members 60A, 60B. Only the lower portion of the straddle packer system 100 is illustrated in FIGS. 7 and 8. Referring to FIG. 7, an upper ring member 92 is coupled to the lower end of the flow sub 56, which is coupled to the upper end of the third inner mandrel 65. The lower packer elements 90A, 90B are disposed on the third inner mandrel 65 with a spacer member 91 disposed between the lower packer elements 90A, 90B. The lower ring member 66 is positioned below the lower packer elements 90A, 90B and is coupled to the cone member 67. Referring to FIG. 8, when the cone member 67 is moved downward into engagement with the slips 71 of the anchor 70 by the compression force applied to the system 100, the lower packer elements 90A, 90B are compressed between the upper and lower ring members 92, 66 and actuated into a sealed engagement with the surrounding wellbore. After a treatment operation is conducted, the pressure across the lower packer elements 90A, 90B can be equalized as described above with respect to the first and second lower cup members 60A, 60B.

Figure 9:
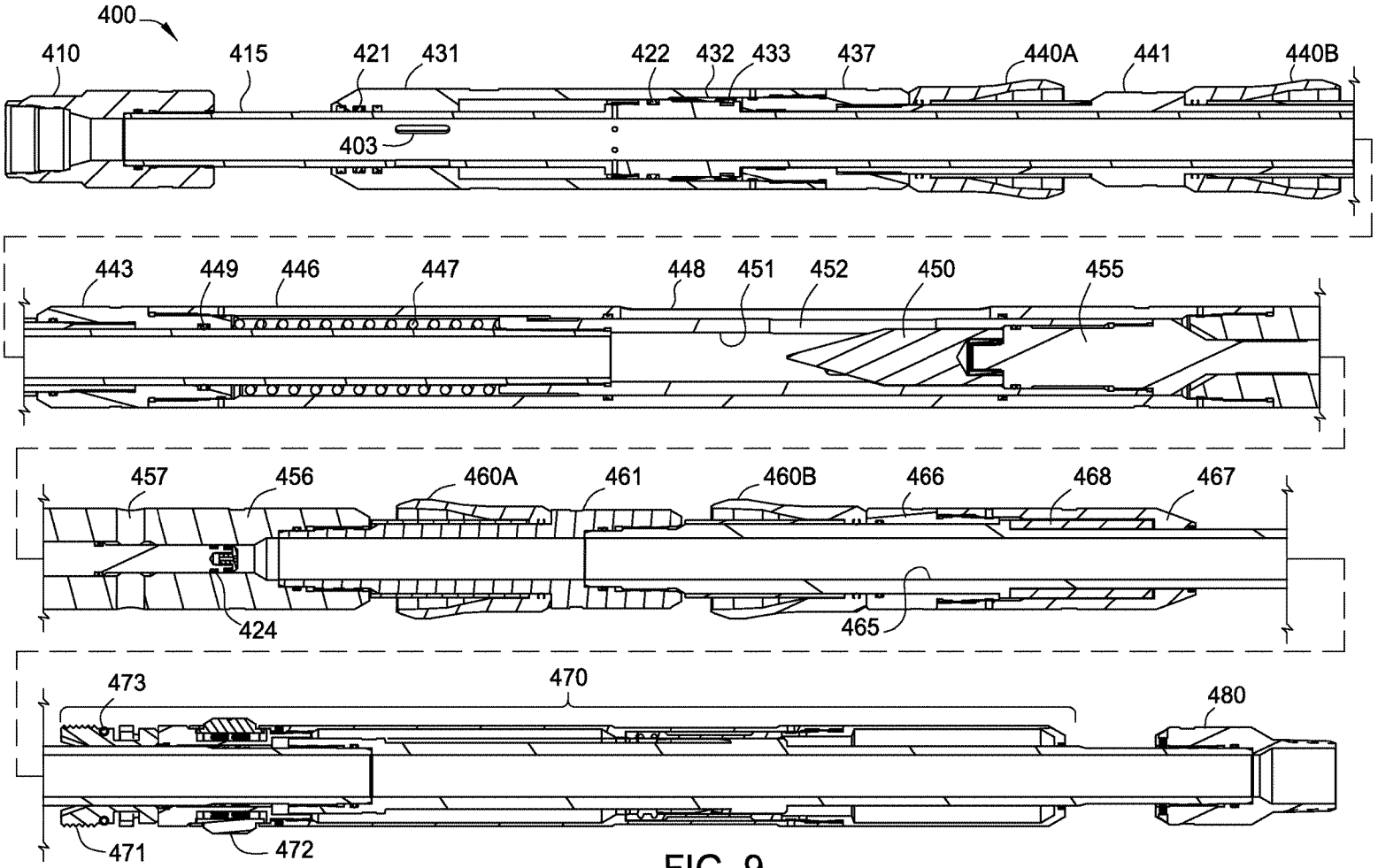
FIG. 9 illustrates a sectional view of a straddle packer system in a run-in position, according to one embodiment.

FIG. 9 illustrates a sectional view of a straddle packer system 400 in a run-in position, according to one embodiment. The components of the straddle packer system 400 that are similar to the components of the straddle packer system 100 described above include the same reference numerals but with a "400-series" designation. A full description of each component that is similar to the components of the straddle packer system 100 described above will not be repeated herein for brevity. The embodiments of the system 100 can be used with the embodiments of the system 400 and vice versa.

One difference of the system 400 illustrated in FIG. 9 from the system 100 is that the components of the upper equalizing valve have been removed or combined with the components of the upper seal member. As illustrated in FIG. 9, the system 400 includes a top sub 410 coupled to an upper inner mandrel 415. The upper inner mandrel 415 extends through a top housing 431, which is coupled to a top connector 437, which is coupled to an outer mandrel 441 that supports first and second upper cup members 440A, 440B.

The upper inner mandrel 415 includes one or more ports 403, which when the system 400 is in the run-in position are positioned within the top housing 431 between seal members 421, 422. The seal members 421, 422 isolate fluid communication between the inner bore of the upper inner mandrel 415 and the surrounding wellbore annulus through the ports 403 when the system 400 is in the run-in position. The seal areas across the seal members 421, 422 are arranged so that the upper inner mandrel 415 is pressure volume balanced or pressure biased in a downward direction when the system 400 is pressurized, in a similar manner as the first inner mandrel 15 of the system 100 described above. A c-ring 433 and a c-ring sleeve 432 are positioned between the top housing 431 and the upper inner mandrel 415 to help maintain the system 400 in the run-in position by providing some resistance to upward movement of the upper inner mandrel 415 relative to the top housing 431, similar to the c-ring 33 and the c-ring sleeve 32 of the system 100.

The upper inner mandrel 415 extends through a bottom connector 443 and is coupled to the upper end of an inner flow sleeve 451, which has one or more ports 452. The inner flow sleeve 451 is coupled to a valve member 455, which supports a seal member 424 that isolates fluid flow through the lower end of the system 400 via one or more ports 457 of a flow sub 456 when the system 400 is in the run-in position. Another seal member 449 is positioned between the bottom connector 443 and the upper inner mandrel 435. The seal area formed across the seal member 449 is greater than the seal area formed across the seal member 424 so that when the system 400 is pressurized, the pressurized fluid forces the upper inner mandrel 415 in the upward direction.

However, the downward force applied to the upper inner mandrel 415 generated by the seal members 421, 422 is greater than the upward force generated by the seal members 449, 424, resulting in the upper inner mandrel 415 being biased in the downward direction when the system 400 is initially pressurized. Alternatively, the positions of the seal members 421, 422, 449, 424 are configured to ensure that the upper inner mandrel 415, the inner flow sleeve 451, and the valve member 455 are pressure volume balanced so that when the system 400 is pressurized the sum of the forces on these components are in equilibrium such that these components remain in the run-in position and do not move in the upward or downward direction. Specifically, the downward force acting on the upper inner mandrel 415 generated by the seal members 421, 422 is substantially equal to the upward force acting on the upper inner mandrel 415 generated by the seal members 449, 424, e.g. pressure volume balanced.

The upper end of the bottom connector 443 is coupled to the outer mandrel 441, and the lower end of the bottom connector 443 is coupled to an outer flow sleeve 446, which has one or more ports 448 that are in fluid communication with the ports 452 of the inner flow sleeve 451. A biasing member 447, such as a spring, is disposed between the bottom connector 443 and the inner flow sleeve 451, and biases the inner flow sleeve 451 and the valve member 455 into the run-in position. The upper end of the inner flow sleeve 451 includes a splined engagement with the outer flow sleeve 446 that rotationally couples the inner flow sleeve 451 to the outer flow sleeve 446 but allows relative axial movement between the inner flow sleeve 451 and the outer flow sleeve 446. A flow diverter 50 is coupled to the valve member 455 to divert fluid flow toward the ports 452, 448.

The lower end of the flow sub 456 is coupled to the upper end of a mandrel extension 461, which is coupled to a lower inner mandrel 465. A first lower cup member 460A is supported by and disposed on the mandrel extension 461. A second lower cup member 460B is supported by and disposed on the lower inner mandrel 465. A lower ring member 466 is positioned below the second lower cup member 460B, and is coupled to a cone member 467. A loading sleeve 468 is disposed between the cone member 467 and the lower inner mandrel 465. The lower end of the lower inner mandrel 465 extends through the lower ring member 466 and the cone member 467, and is coupled to an anchor 470 having one or more slips 471 and one or more drag blocks 472. The slips 471 are biased radially inward by a biasing member 473, such as a spring, and are actuated radially outward by the cone member 467 to engage the walls of the wellbore to secure the system 400 in the wellbore. The anchor 470 is coupled to a bottom sub 480, which provides a threaded connection to one or more other tools that can be used in the wellbore.

Figure 10:
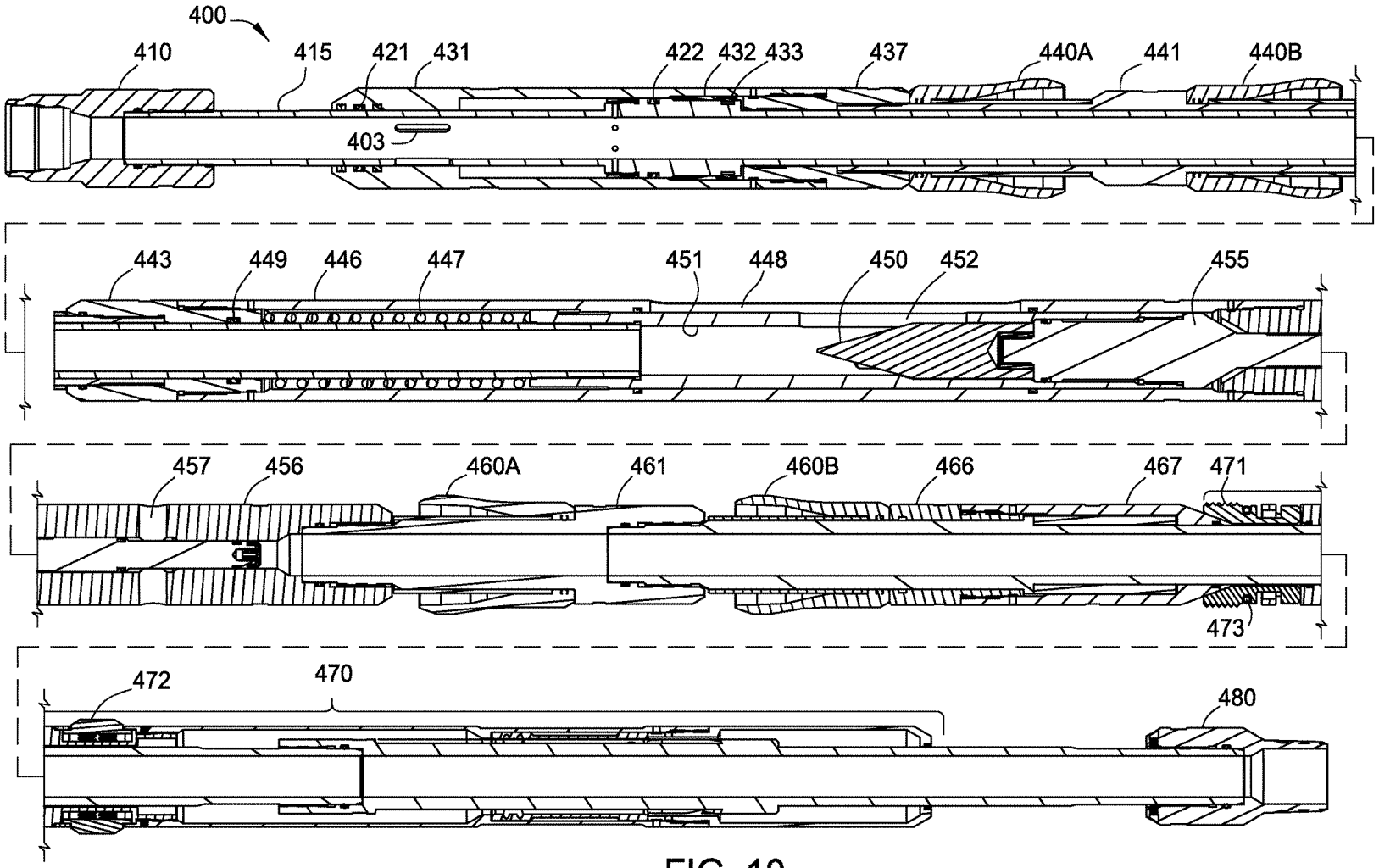
FIG. 10 illustrates a sectional view of the straddle packer system in a set position, according to one embodiment.

FIG. 10 illustrates a sectional view of the straddle packer system 400 in a set position, after being lowered into a wellbore by a work string that is coupled to the top sub 410. The system 400 is positioned in the wellbore so that the upper cup members 440A, 440B are located above a zone of the wellbore to be isolated, and so that the lower cup members 460A, 460B are located below the zone to be isolated. When in the desired position, the anchor 470 is actuated (in a similar manner as the anchor 70 of the system 100) to secure the system 400 in the wellbore.

As illustrated in FIG. 10, a compression force, such as the weight of the work string, is applied to or set down on the system 400 to move the components of the system 400 in a downward direction relative to the anchor 470. The compression force moves the cone member 467 into engagement with the slips 471 of the anchor 470. The cone member 467 forces the slips 471 radially outward against the bias of the biasing member 473 and into engagement with the wellbore to secure the system 400 in the wellbore.

A pressurized fluid can be pumped down through the work string into the flow bore of the system 400, and injected out of the system 400 through the ports 448, 452 into the isolated zone in the wellbore. The upper and lower cup members 440A, 440B, 460A, 460B are energized into sealed engagement by the pressurized fluid to prevent the pressurized fluid from flowing up or down the annulus past the upper and lower cup members 440A, 440B, 460A, 460B. After the pressurized fluid is injected into the isolated zone and/or when desired, the pressure across the upper and lower cup members 440A, 440B, 460A, 460B can be equalized simultaneously using the upper and lower equalizing valves of the system 400. The components of the system 400 disposed between the top housing 431 and the top connector 437, including the upper inner mandrel 415, generally form the upper equalizing valve of the system 400. The components of the system 400 disposed between the bottom connector 443 and the flow sub 456, also including the upper inner mandrel 415, generally form the lower equalizing valve of the system 400.

Figure 11:
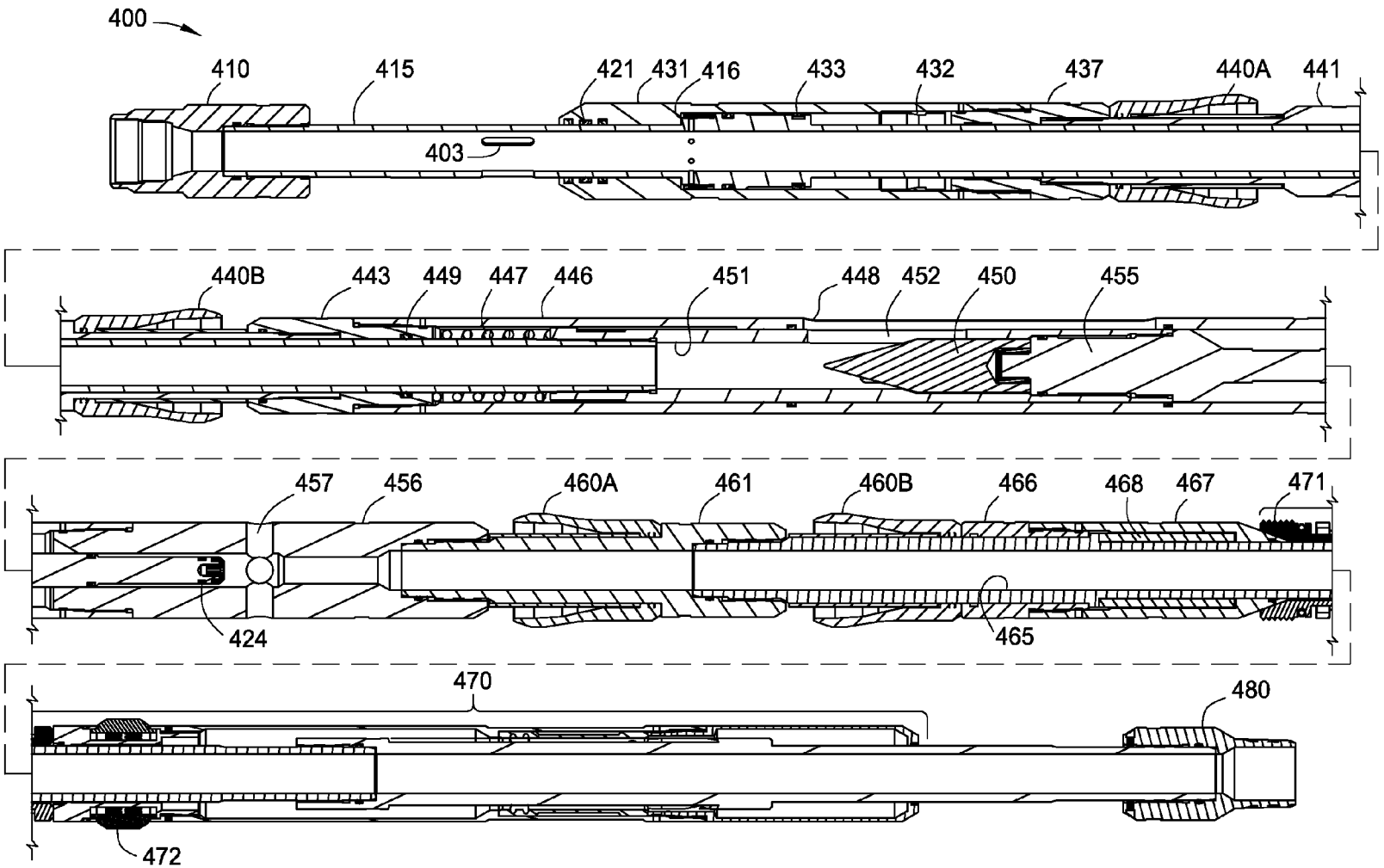
FIG. 11 illustrates a sectional view of the straddle packer system in a first unloading position, according to one embodiment.

FIG. 11 illustrates a sectional view of the straddle packer system 400 in an unloading position to equalize the pressure across the upper and lower cup members 440A, 440B, 460A, 460B using the upper and lower equalizing valves of the system 400. A tension force can be applied to the system 400 using the work string to open fluid communication through the ports 403 in the upper inner mandrel 415. The tension force will pull the upper inner mandrel 415 in an upward direction relative to the top housing 431, which is secured in the wellbore by the anchor 470. The tension force must be sufficient to force the c-ring 433 across the c-ring sleeve 432, and sufficient to compress the biasing member 447 between the bottom connector 443 and the inner flow sleeve 451. At the same time, the tension force applied to the inner mandrel 415 is transmitted to and pulls the inner flow sleeve 451, which moves the valve member 455 into a position that opens fluid flow through the lower end of the system 400 via the ports 457 of the flow sub 456.

As illustrated in FIG. 11, the ports 403 are moved to a position outside of the top housing 431, which opens fluid communication between the wellbore annulus surrounding the system 400 and the inner flow bore of the system 400 through the ports 403 of the upper inner mandrel 415. Similarly, the valve member 455 is moved to a position where the seal member 424 opens fluid communication between the wellbore annulus surrounding the system 400 and the inner flow bore of the system 400 through the ports 457 of the flow sub 456. Pressure above and below the upper and lower cup members 440A, 440B, 460A, 460B is simultaneously equalized since the annulus above and below the upper and lower cup members 440A, 440B, 460A, 460B are in fluid communication through the flow bore of the system 400 via the ports 403, 457. The upper and lower cup members 440A, 440B, 460A, 460B are not moved when equalizing the pressure across the upper and lower cup members 440A, 440B, 460A, 460B to prevent swabbing within the wellbore.

The upper inner mandrel 415 moves in an upward direction until a shoulder 416 of the upper inner mandrel 415 engages the top housing 431. The tension force is then transmitted from the top housing 431 to the top connector 437, the outer mandrel 441, the bottom connector 443, the outer flow sleeve 446, the flow sub 456, the mandrel extension 461, the lower inner mandrel 465, the lower ring member 466, and the cone member 467. The upward force moves the cone member 467 away from the anchor 470 (shown in FIG. 12) and from underneath the slips 471 to allow the biasing member 473 to retract the slips 471 radially inward from engagement with the wellbore.

Figure 12:
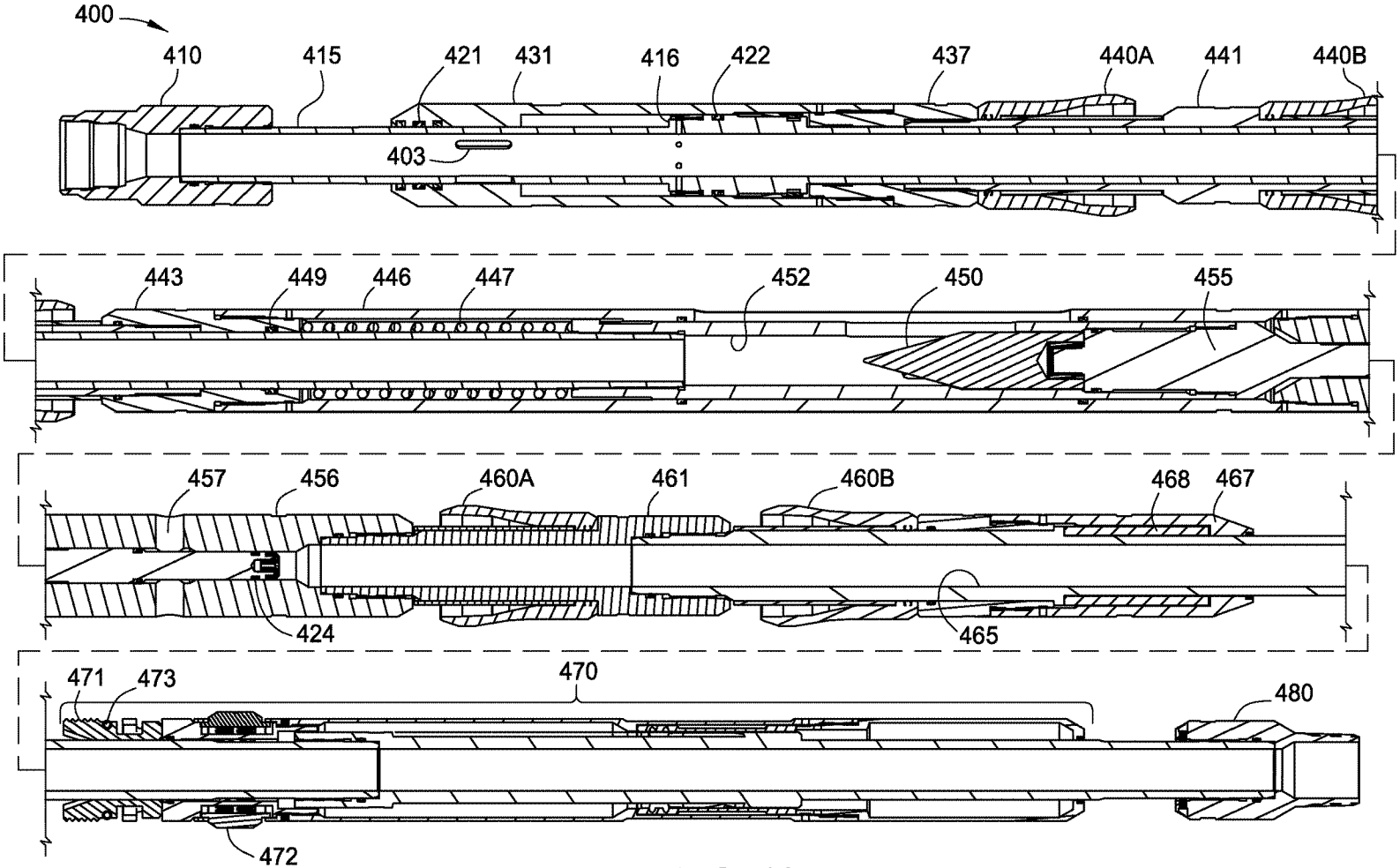
FIG. 12 illustrates a sectional view of the straddle packer system in an unset position, according to one embodiment.

FIG. 12 illustrates a sectional view of the straddle packer system 400 in an unset position or back into the run-in position. The tension force applied to the work string can be released and/or a compression force, such as the weight of the work string, can be set down on the system 400 to move the ports 403 of the upper inner mandrel 415 back into a position between the seal members 421, 422. At the same time, the releasing of the tension force and/or the compression force moves the valve member 455 back into a position where the seal member 424 isolates fluid flow into the lower end of the system 400 via the ports 457 of the flow sub 456.

In one embodiment, both of the upper and lower equalizing valves of the systems 100, 400 can be deployed or lowered into the wellbore while in the closed position (the equalizing valves being shown in the closed position in FIG. 1A and FIG. 9). In another embodiment, both of the upper and lower equalizing valves of the systems 100, 400 can be deployed or lowered into the wellbore while in the open position (the equalizing valve being shown in the open position in FIG. 4 and FIG. 11), and then subsequently actuated into the closed position using a compression force. In another embodiment, one of the upper equalizing valve or the lower equalizing valve of the systems 100, 400 can be deployed or lowered into the wellbore in the open position, while the other one of the upper equalizing valve or the lower equalizing valve is in the closed position. Subsequently, the upper or lower equalizing valve that is in the open position can be moved to the closed position using a compression force.

While the foregoing is directed to embodiments of the invention, other and further embodiments of the invention may be devised without departing from the basic scope thereof, and the scope thereof is determined by the claims that follow.

The invention claimed is:

1. A straddle packer system, comprising:

an upper seal member;

a lower seal member;

an upper equalizing valve having an upper outer housing, an upper inner mandrel, and a biasing member disposed between the upper outer housing and the upper inner mandrel, wherein the upper outer housing is movable against a bias force of the biasing member and relative to the upper seal member and the upper inner mandrel into a first unloading position to equalize pressure across the upper seal member, wherein the upper seal member does not move when the upper equalizing valve is moved into the first unloading position;

a lower equalizing valve movable into a second unloading position to equalize pressure across the lower seal member, wherein the lower seal member does not move when the lower equalizing valve is moved into the second unloading position; and an anchor, wherein:

the biasing member biases the upper inner mandrel into a run-in position where one or more ports formed through the upper inner mandrel are positioned within the upper outer housing of the upper equalizing valve;

the one or more ports are positioned outside of an end cap member of the upper outer housing to open fluid communication to an annulus surrounding the one or more ports; and a c-ring disposed within the upper outer housing is compressed into a groove formed in the upper inner mandrel when the upper outer housing is moved to the first unloading position.

2. The system of claim 1, wherein the upper equalizing valve is configured to move into the first unloading position before the lower equalizing valve is moved into the second unloading position.

3. The system of claim 1, wherein the upper equalizing valve and the lower equalizing valves are configured to be simultaneously movable into the first and second unloading positions.

4. The system of claim 1, wherein the upper inner mandrel has one or more ports, wherein the upper outer housing and the upper inner mandrel are movable relative to each other to a position where the ports open fluid communication to equalize pressure across the upper seal member.

5. The system of claim 1, wherein the lower equalizing valve includes an inner mandrel movable relative to an outer housing having one or more ports through which fluid communication is opened to equalize pressure across the lower seal member.

6. The system of claim 1, wherein the upper seal member is a cup seal member that is energized by pressurized fluid, and wherein the lower seal member is a cup seal member that is energized by pressurized fluid or a packer element that is energized by a compression or a tension force.

7. The system of claim 1, wherein the upper inner mandrel of the upper equalizing valve is pressure volume balanced when the system is pressurized, or biased in a downward direction by pressurized fluid when the system is pressurized.

8. The system of claim 1, wherein an inner mandrel of the lower equalizing valve is pressure volume balanced when the system is pressurized, or biased in a downward direction by pressurized fluid when the system is pressurized.

9. The system of claim 1, wherein an inner mandrel of the lower equalizing valve is biased in an upward direction by pressurized fluid when the system is pressurized.

10. The system of claim 1, wherein the lower equalizing valve includes a biasing member biasing a valve member disposed within a lower outer housing into a run-in position to close fluid flow through one or more ports formed in a flow sub of the lower equalizing valve.

11. The system of claim 10, wherein a lower inner mandrel is movable against a bias force of the biasing member to move the valve member into the second unloading position to open fluid communication through the one or more ports.

12. The system of claim 11, further comprising a c-ring that is compressed into a groove formed in the lower inner mandrel when the lower inner mandrel is moved to the second unloading position.

13. The system of claim 1, further comprising a spacer pipe coupling disposed between the upper equalizing valve and the lower equalizing valve, wherein the spacer pipe coupling is coupled to the lower equalizing valve by a swivel.

14. The system of claim 1, wherein the upper inner mandrel has a shoulder configured to transmit a compression force to set the anchor.

15. The system of claim 1, wherein the upper inner mandrel has a shoulder configured to transmit a tension force to unset the anchor.

16. A method of operating a straddle packer system, comprising:

lowering the system into a wellbore;

actuating an anchor of the system into engagement with the wellbore;

energizing an upper seal member and a lower seal member of the system to isolate a section of the wellbore;

equalizing pressure across the upper seal member by applying a tension force to actuate an upper equalizing valve of the system, wherein the upper equalizing valve has an upper outer housing, an upper inner mandrel, and a biasing member disposed between the upper outer housing and the upper inner mandrel, wherein the upper outer housing is movable against a bias force of the biasing member and relative to the upper seal member and the upper inner mandrel to equalize pressure across the upper seal member, wherein the upper seal member does not move when the upper equalizing valve is actuated by the tension force; and equalizing pressure across the lower seal member by applying the tension force to actuate a lower equalizing valve of the system, wherein the lower seal member does not move when the lower equalizing valve is actuated by the tension force.

17. The method of claim 16, further comprising actuating the upper equalizing valve before actuating the lower equalizing valve.

18. The method of claim 16, further comprising simultaneously actuating the upper equalizing valve and the lower equalizing valve.

19. The method of claim 16, further comprising moving the outer housing of the upper equalizing valve relative to the upper inner mandrel having one or more ports to open fluid communication to an annulus surrounding the ports to equalize pressure across the upper seal member.

20. The method of claim 16, further comprising moving the upper inner mandrel having one or more ports relative to the upper outer housing of the upper equalizing valve to open fluid communication to an annulus surrounding the ports to equalize pressure across the upper seal member.

21. The method of claim 16, further comprising moving a valve member of the lower equalizing valve to open fluid communication through one or more ports of a flow sub to equalize pressure across the lower seal member.

22. The method of claim 16, wherein the upper equalizing valve and the lower equalizing valve are in at least one of an open position and a closed position while the system is lowered into the wellbore.

* * * * *